US007557280B2

(12) United States Patent
Fujiwara

(10) Patent No.: US 7,557,280 B2
(45) Date of Patent: Jul. 7, 2009

(54) AUTOMATIC PLAYER MUSICAL INSTRUMENT PRODUCING SHORT TONES WITHOUT MISSING TONE AND AUTOMATIC PLAYING SYSTEM USED THEREIN

(75) Inventor: Yuji Fujiwara, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/612,870

(22) Filed: Dec. 19, 2006

(65) Prior Publication Data

US 2007/0169608 A1 Jul. 26, 2007

(30) Foreign Application Priority Data

Jan. 26, 2006 (JP) ..... 2006-018083

(51) Int. Cl.
*A63H 5/00* (2006.01)
*G10H 1/40* (2006.01)
*G10F 1/02* (2006.01)

(52) U.S. Cl. ..... 84/13; 84/600; 84/649; 84/651; 84/670; 84/19; 84/20; 84/23; 84/24; 84/244

(58) Field of Classification Search ..... 84/600–602, 84/609–616, 622–624, 634–638, 651, 647, 84/649, 658, 666–670, 723, 725, 726, 730, 84/731, 742, 12, 13, 19–29, 170–172, 174, 84/216, 224, 243–255
See application file for complete search history.

(56) References Cited

U.S. PATENT DOCUMENTS

| | | | | |
|---|---|---|---|---|
| 5,648,621 | A | 7/1997 | Sasaki et al. | |
| 5,652,399 | A | 7/1997 | Fujiwara et al. | |
| 5,691,489 | A | 11/1997 | Fujiwara et al. | |
| 5,731,530 | A | 3/1998 | Fujiwara et al. | |
| 6,051,762 | A * | 4/2000 | Fujiwara et al. | 84/21 |
| 2005/0092164 | A1 * | 5/2005 | Fujiwara et al. | 84/645 |
| 2005/0150361 | A1 * | 7/2005 | Muramatsu et al. | 84/626 |
| 2005/0211049 | A1 * | 9/2005 | Fujiwara et al. | 84/13 |
| 2005/0247182 | A1 * | 11/2005 | Sasaki et al. | 84/13 |

FOREIGN PATENT DOCUMENTS

| | | |
|---|---|---|
| GB | 2331831 A | 2/1999 |
| JP | 3541411 | 7/1995 |
| JP | 8-160942 | 6/1996 |

* cited by examiner

*Primary Examiner*—Jeffrey Donels
*Assistant Examiner*—Christopher Uhlir
(74) *Attorney, Agent, or Firm*—Harness, Dickey & Pierce, PLC

(57) ABSTRACT

An automatic player piano is a combination between an acoustic piano and an automatic playing system, and a grand piano and an upright piano are used as the acoustic piano; the grand piano has action units prompter than action units of the upright piano so that a half-stroke recorded through the grand piano is not reproducible by the upright piano; the automatic playing system causes the hammers to rotate toward the strings without any escape thereby compensating the poor promptness with the short keystroke of the keys until the rotation of hammers.

20 Claims, 9 Drawing Sheets

AUTOMATIC PLAYER MUSICAL INSTRUMENT PRODUCING SHORT TONES WITHOUT MISSING TONE AND AUTOMATIC PLAYING SYSTEM USED THEREIN

FIELD OF THE INVENTION

This invention relates to an automatic player musical instrument and, more particularly, to an automatic player musical instrument reproducing tones along a music passage on the basis of music data codes.

DESCRIPTION OF THE RELATED ART

A piano is a typical example of the keyboard musical instrument, and an automatic player piano is a combination between the piano and an automatic playing system. A human pianist plays tunes on the automatic player piano as similar to those playing the tunes on a standard acoustic piano. The automatic playing system reenacts the performance on the piano without any fingering of the human player, and makes it possible to enjoy the tunes.

In the following description, term "front" is indicative of a position closer to the human player, who gets ready to player a tune, than a position modified with term "rear". A line drawn between a front position and a corresponding rear position extends in a "fore-and-aft direction", and a "lateral direction" crosses the fore-and-aft direction at right angle.

The automatic playing system largely comprises an array of solenoid-operated actuators and a controller. The array of solenoid-operated actuators is provided under the rear portions of the black and white keys, and the solenoid-operated actuators are energized with a driving signal selectively supplied from the controller. While the driving signal is flowing through the solenoid of the solenoid-operated actuator, magnetic field is created and the magnetic force is exerted on the plunger. The plunger upwardly pushes the rear portion of the associated black key or white key so that the front portion of the key is sunk as if a human player depresses it.

The magnetic force is controllable with the amount of mean current of the driving signal. In the playback, the controller determines target key trajectories, each of which expresses a key position varied with tine, on the basis of music data codes, and forces the black keys and white keys to travel on the target key trajectories through a servo control loop. If the black key or white key is found at the back of the target key position, the controller increases the amount of mean current so that the black or white key is accelerated. On the other hand, if the black key or white key is found in front of the target key position, the controller decreases the amount of mean current so that the black or white key is decelerated. If the black key or white key passes through a certain point, which is referred to as a "reference point", on the target trajectory at a "reference key velocity", the jack exerts proper force on the hammer, and the hammer is brought into contact with the string at a final hammer velocity. The hammer gives rise to vibrations of the string, and a tone is produced through the vibrations of string. The loudness of tones is proportional to the final hammer velocity immediately before the collision, and the reference key velocity at the reference point is proportional to the final hammer velocity. Thus, the loudness of tones is controllable with the driving signal.

While a professional pianist is playing a tune on a piano, he or she depresses and releases the black keys and white keys in various sorts of renditions. One of the styles of renditions is called as a "half stroke". In the half stroke, the pianist releases a black key or white key on the way to the end position, and depresses a black key or white key on the way to the rest position, again. On the other hand, when the black key or white key is depressed at the rest position, and when the black key or white key is released at the end position, the style of rendition is hereinafter referred to as a "full stroke".

It is impossible to reproduce the half stroke through the above-described servo control, because black key or white key is repeatedly brought into collision with the string at intervals shorter than those in the full stroke. A control technique for the half-stroke is disclosed in Japan Patent Application No. Hei 5-344242, and the Japan Patent Application resulted in Japan Patent No. 3541411, which is corresponding to U.S. Pat. No. 5,652,399. According to the Japanese Patent, the controller checks a target key trajectory to see whether or not the previous target key trajectory crosses the target key trajectory before the end position and rest position. When the answer is given negative, the black or white key is depressed or released in the full stroke. However, if the answer is given affirmative, the black or white keys are to be depressed or released in the half stroke. In this situation, the controller starts to supply the driving signal to the solenoid-operated actuator before the previous key reaches the rest position or end position.

The half stroke is used in repetition of a black key or a white key. Even if the controller forces the black key or white key to travel on the trajectory for the repetition, the black key or white key tends not to follow due to the short repetition periods. This results in missing tone or missing tones. In other words, even if a tone is repeated on a music score certain times, the listener hears the tone times once or twice less than the certain times. A countermeasure is proposed in Japan Patent Application No. Hei 6-298511, which was published as Japan Patent Application laid-open No. Hei 8-160942, and U.S. Patent No. 5,648,621 was assigned to the corresponding U.S. patent application. According to the Japan Patent Application laid-open, when a group of music data codes notifies the controller to repeat a tone, the controller starts to depress and release the black key or white key at certain earlier than the normal timing.

In general, the promptness of pianos is dependent on the structure of action units, which are provided between the black keys/white keys and the hammers. Various sorts of action units are employed in the pianos. Grand pianos have the action units different in structure from the action units employed in upright pianos. The action units employed in the standard grand pianos are prompter than the action units employed in the standard upright pianos are. In other words, the action units employed in the standard upright pianos are inferior to the action units employed in the standard grand piano. In fact, the action units employed in a grand piano can follow the repetition at 13 Hz. However, it is difficult for the action units employed in the standard upright pianos to follow such high-speed repetition. It is said that the action units employed in the standard upright pianos are saturated at 8 Hz.

The difference in promptness is derived from the structure of action units, and difference in structure of action units is found among different models of grand piano, different models of upright piano, different manufacturers and so forth.

In case where an automatic player reenacts a performance of a tune carried out on the piano combined with the automatic player, the action units of the piano participates in both of the original performance and reproduced performance so that the listener feels the latter performance reproduced at fairly good fidelity to the former performance.

However, the difference in structure of action units damages the fidelity to the original performance. Such the poor fidelity is liable to become apparent in the automatic playing on an upright piano on the basis of music data codes recorded through a grand piano. Similarly, even if an original performance and playback are respectively carried out through grand pianos, the poor fidelity is found in so far as the action units of the grand piano used in the playback are less prompt rather than the action units of the grand piano used in the recording. In case where a user composes a tune through a personal computer system without consideration of the promptness of action units incorporated in an automatic player piano used in an automatic performance, there is a possibility to miss a tone or tones during repetition.

The manufacturers of automatic player pianos do not take the phenomenon, i.e., the missing tone to missing tones due to the difference in structure of action units into account. Any countermeasure is not proposed in Japan Patent No. 3541411. Although description on the difference among pianos is incorporated in Japan Patent Application laid-open No. Hei 6-298511, the prior art technique disclosed therein causes the reproduced performance to be curious because of the tones reproduced at the timing different from that in the original performance. It is difficult to reproduce the high-speed repetition through the prior art automatic player upright pianos disclosed in the Japan Patent and Japan Patent Application laid-open.

SUMMARY OF THE INVENTION

It is therefore an important object of the present invention to provide an automatic player keyboard musical instrument, which can reproduce tones at extremely time intervals without any missing tone.

It is also an important object of the present invention to provide an automatic playing system which makes an acoustic keyboard musical instrument retrofitted to the automatic player keyboard musical instrument.

The present inventors contemplated the problem inherent in the prior art automatic player keyboard musical instrument, and noticed that escape between jacks and hammers is time consuming. The present inventors found that it was possible to strike strings with the hammers without the escape. The present invention was made on the basis of the discovery.

To accomplish the object, the present invention proposes to prohibit jacks from the escape in high-speed key movements such as the repetition.

In accordance with one aspect of the present invention, there is provided an automatic player musical instrument for performing a piece of music on the basis of pieces of music data, the automatic player musical instrument comprises a musical instrument including plural manipulators independently moved for specifying the pitch of tones to be produced selectively through full-stroke movements and other movements, plural action units respectively actuated by the plural manipulators and provided with jacks, respectively plural hammers associated with the jacks, respectively and driven for rotation through escape of the jacks and a tone generator producing the tones at the pitch specified through the plural manipulators in response to the rotation of the plural hammers and an automatic playing system including plural actuators provided in association with the plural manipulators, respectively, and responsive to a driving signal so as selectively to move the plural manipulators, a reference trajectory producer examining the pieces of music data to see whether the full-stroke movements or the other movements are to be requested for the plural manipulators and determining reference key trajectory groups for the plural manipulators depending upon the movements to be requested and a controller connected to the plural actuators and the reference trajectory producer and regulating a magnitude of the driving signal so as to cause the plural manipulators to travel on the reference trajectory groups, and one of the reference key trajectory groups for one of the plural manipulators causes associated one of the plural hammers to start the rotation without the escape so as to produce one of the other movements.

In accordance with another aspect of the present invention, there is provided an automatic playing system for producing tones on the basis of pieces of music data through a musical instrument having plural manipulators, plural action units respectively connected to the plural manipulators and respectively provided with jacks, plural hammers driven for rotation through escape of the jacks and a tone generator producing the tones in response to the rotation of the hammers, the automatic playing system comprises plural actuators provided in association with the plural manipulators, respectively, and responsive to a driving signal so as selectively to move the plural manipulators, a reference trajectory producer examining the pieces of music data to see whether full-stroke movements or other movements are to be requested for the plural manipulators and determining reference key trajectory groups for the plural manipulators depending upon the movements to be requested and a controller connected to the plural actuators and the reference trajectory producer, and regulating a magnitude of the driving signal so as to cause the plural manipulators to travel on the reference trajectory groups, and one of the reference key trajectory groups for one of the plural manipulators causes associated one of the plural hammers to start the rotation without the escape so as to produce one of the other movements.

BRIEF DESCRIPTION OF THE DRAWINGS

The features and advantages of the automatic player keyboard musical instrument and automatic playing system will be more clearly understood from the following description taken in conjunction with the accompanying drawings, in which.

DESCRIPTION OF THE PREFERRED EMBODIMENTS

Figure 1:
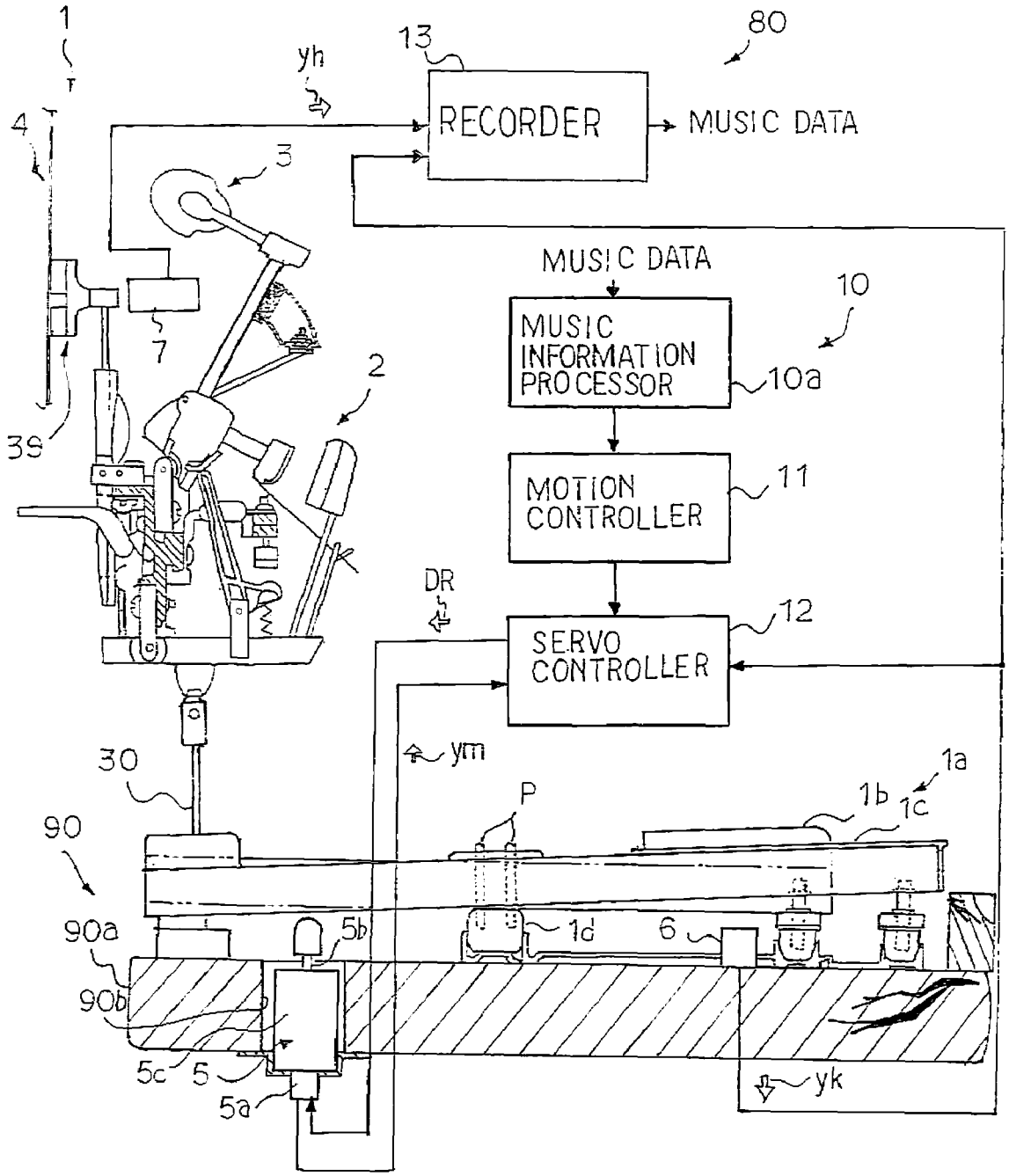
FIG. 1 is a schematic cross sectional side view showing the structure of an automatic player piano according to the present invention.

In the following description, term "front" is indicative of a position closer to a player, who gets ready for fingering on a keyboard musical instrument, than a position modified with term "rear". A line drawn between a front position and a corresponding rear position extends in a "fore-and-aft direction", and a lateral direction crosses the fore-and-aft direction at right angle. An up-and-down direction is normal to a plane defined by the fore-and-aft direction and lateral direction. Term "clockwise" and term "counter clockwise" are determined in a figure in which a rotational component part is illustrated.

An automatic player musical instrument embodying the present invention largely comprises a musical instrument and an automatic playing system. A human player plays a piece of music on the musical instrument, and the automatic playing system reenacts the performance on the musical instrument without any fingering of the human player.

The musical instrument includes plural manipulators, plural action units, plural hammers and a tone generator. The manipulators are independently moved for specifying the pitch of tones to be produced. The plural action units are respectively linked with the plural manipulators so that the plural action units are actuated by the moving manipulators. The plural action units have jacks, respectively, and the jacks are provided in association with the hammers. While the human player or automatic playing system is actuating the action unit by means of the associated manipulator, the jack escapes from the hammer, and the hammer is driven for rotation through the escape of jack. The tone generator is responsive to the rotation of hammers so as to produce the tones at the pitch specified through the manipulators. Thus, the human player or automatic playing system plays the musical instrument for producing the tones along music passages.

The automatic playing system is responsive to pieces of music data, which express a performance on a piece of music, so as to reenact the performance without any fingering of the human player. The automatic playing system includes plural actuators, a reference trajectory producer and a controller. The plural actuators are respectively provided for the plural manipulators, and a driving signal is selectively supplied from the controller to the plural actuators so as to give rise to the movements of manipulators.

The reference trajectory producer respectively determines reference trajectory groups for the manipulators to be moved on the basis of the pieces of music data. The reference key trajectory group is indicative of values of target position of each manipulator in terms of time. When the manipulator passes through reference points on the reference trajectories in the reference trajectory group at reference velocity, the associated hammer makes the tone generator to produce the tone at target loudness, and the tone is decayed at a target time.

In case where the manipulator is to be travel over a full-stroke, the reference trajectory producer prepares a certain sort of reference trajectory group. There is another sort of reference trajectory groups which causes the hammers to start the rotation without the escape of the associated jack. Since the manipulator is not expected to make the jack escape from the hammer, the stroke of manipulator is shorter than the full-stroke, and the short stroke of manipulator makes it possible to produce a tone or tones at short time intervals. Even if the promptness of action units is poor, it is possible to produce the tone or tones on the basis of the pieces of music data, which was produced in the original performance on another musical instrument with action units superior in promptness than the action units. Thus, the reference trajectory producer prepares the appropriate reference trajectory groups for the manipulators to be moved.

The approach of this invention is preferable to the acceleration of manipulators, because the accelerated manipulators make the associated hammers reach the strings earlier than the timing defined in the pieces of music data.

The controller is connected to the reference trajectory producer and plural actuators. When the reference trajectory group is supplied from the reference trajectory producer to the controller, the controller adjusts the driving signal to an appropriate magnitude to the given reference trajectory group, and supplies the driving signal to the associated actuator. With the driving signal, the actuator forces the manipulator to travel on the reference trajectories in the reference trajectory group, and reproduces the movements of the manipulator during the original performance.

As will be understood from the foregoing description, the reference trajectory produces prepares the reference trajectory groups for the manipulators to be quickly moved, and compensates the time lag for the action units poor in the promptness.

First Embodiment

Structure of Automatic Player Piano

Referring to FIG. 1 of the drawings, an automatic player piano embodying the present invention largely comprises an upright piano 1, an automatic playing system 10 and a recording system 80. A human player fingers a piece of music on the upright piano 1, and acoustic piano tones are produced along the music passage in the upright piano 1. The automatic playing system 10 and recording system 80 are installed in the upright piano 1. The original performance on the upright piano 1 is recorded through the recording system 80, and the automatic playing system 10 reenacts a performance on the upright piano on the basis of pieces of music data.

The upright piano 1 includes a keyboard 1*a* having black keys 1*b* and white keys 1*c*, action units 2, hammers 3, strings 4, dampers 39 and a piano cabinet 90. An inner space is defined in the piano cabinet 90, and the action units 2, hammers 3, dampers 39 and strings 4 occupy the inner space. A key bed 90*a* forms a part of the piano cabinet 90, and the keyboard 1*a* is mounted on the key bed 90*a*.

The black keys 1*b* and white keys 1*c* are laid on the well-known pattern, and extend in parallel to the fore-and-aft direction. Pitch names are respectively assigned to the black keys 1*b* and white keys 1*c*. Balance key pins P offer fulcrums to the black keys 1*b* and white keys 1*c* on a balance rail 1*d*. Capstan buttons 30 are upright on the rear portions of the black keys 1*b* and the rear portions of the white keys 1*c*, and are held in contact with the action units 2. Thus, the black keys 1*b* and white keys 1*c* are respectively linked with the action units 2 so as to actuate the action units 2 during travels from rest positions toward end positions. While the weight of action units are being exerted on the rear portions of black keys 1*b* and the rear portions of which keys 1*c*, the black keys 1*b* and white keys 1*c* stay at respective rest positions. While a human player is depressing the front portions of black keys 1*b* and the front portions of white keys 1*c*, the front portions are sunk, and the black keys 1*b* and white keys 1*c* travel from the rest positions to respective end positions. In this instance, when the black keys 1*b* and white keys 1*c* are found at the rest positions, the keystroke is zero. The end positions are spaced from the rest positions by 10 millimeters.

The action units 2 are provided in association with the hammers 3 and dampers 4, and the actuated action units 2 drive the associated hammers 3 and dampers 39 for rotation.

The strings 4 are stretched inside the piano cabinet 90, and the hammers 3 are respectively opposed to the strings 4. The dampers 39 are spaced from and brought into contact with the strings 4 depending upon the key position. While the black keys 1*b* and white keys 1*c* are staying at the rest positions, the dampers 39 are held in contact with the strings 4, and the hammers 3 are spaced from the strings 4. When the black keys 1*b* and white keys 1*c* reach certain points on the way toward the end positions, the dampers 39 leave the strings 4, and are spaced from the strings 4. As a result, the dampers 39 permit the strings 4 to vibrate. The action units 2 give rise to rotation of hammers 3 during the key movements toward the end positions. The hammers 3 are brought into collision with the associated strings 4 at the end of the rotation, and rebound on the strings 4. Thus, the hammers 3 give rise to vibrations of the associated strings 4. The acoustic piano tones are produced through the vibrations of the strings 4 at the pitch names identical with those assigned to the associated black and white keys 1*b*/1*c*.

When the human player releases the black keys 1*b* and white keys 1*c*, the black keys 1*b* and white keys 1*c* start to return toward the rest positions. The dampers 39 are brought into contact with the vibrating strings 4 on the way of keys 1*b*/1*c* toward the rest positions, and prohibit the strings 4 from the vibrations. As a result, the acoustic piano tones are decayed.

The automatic playing system 10 includes solenoid-operated key actuators 5 with built-in plunger sensors 5*a*, key sensors 6, a music information processor 10*a*, a motion controller 11 and a servo controller 12. The music information processor 10*a* motion controller 11 and servo controller 12 stand for functions, which are realized through execution of a subroutine program of a computer program.

A slot 90*b* is formed in the key bed 90*a* below the rear portions of the black and white keys 1*b* and 1*c*, and extends in the lateral direction. The solenoid-operated key actuators 5 are arrayed inside the slot 90*b*, and each of the solenoid-operated key actuators 5 has a plunger 5*b* and a solenoid 5*c*. The solenoids 5*c* are connected in parallel to the servo controller 12, and are selectively energized with the driving signal DR so as to create respective magnetic fields. The plungers 5*b* are provided in the magnetic fields so that the magnetic force is exerted on the plungers 5*b*. The magnetic force causes the plungers 5*b* to project in the upward direction, and the rear portions of the black and white keys 1*b* and 1*c* are pushed with the plungers of the associated solenoid-operated key actuators 5. As a result, the black and white keys 1*b* and 1*c* pitch up and down without any fingering of a human player.

The built-in plunger sensors 5*a* respectively monitor the plungers 5*b*, and supply plunger velocity signals ym representative of plunger velocity to the servo controller 12.

The key sensors 6 are provided below the front portions of the black and white keys 1*b*/1*c*, and monitor the black and white keys 1*b*/*c*, respectively. In this instance, an optical position transducer is used as the key sensors 6. Although the optical position transducer disclosed in the above-described Japan Patent is available for the key sensors 6, the key sensors 6 have a detectable range as wide as or wider than the full keystroke, i.e., from the rest positions to the end positions. Plural light-emitting diodes, plural light-detecting diodes, optical fibers and sensor heads form in combination the array of key sensors 6. Each of the sensor heads is opposed to the adjacent sensor heads, and the black/white keys 1*b*/1*c* adjacent to one another are moved in gaps between the sensor heads. Light is propagated from the light-emitting diodes through the optical fibers to selected ones of sensor heads, and light beams are radiated from these sensor heads to the adjacent sensor heads. The light beams are fallen onto the adjacent sensor heads, and the incident light is propagated from the adjacent sensor heads to the light-detecting diodes. The incident light is converted to photo current. Since the black keys 1*b* and white keys 1*c* interrupt the light beams, the amount of incident light is varied depending upon the key positions. The photo current is converted to potential level through the light-detecting diodes so that the key sensors 6 output key position signals yk representative of the key positions. The key sensors 6 supply the key position signals yk representative of current key position of the associated black and white keys 1*b*/1*c* to the servo controller 12.

A performance is expressed by pieces of music data, and the pieces of music data are given to the music information processor 10*a* in the form of music data codes. In this instance, the music data codes are prepared in accordance with the MIDI (Musical Instrument Digital Interface) protocols. A key movement toward the end position and a key movement toward the rest position are respectively referred to as a key-on event and a key-off event, and term "key event" means both of the key-on and key-off events.

The pieces of music data are sequentially supplied to the music information processor 10*a*, and the music information processor 10*a* determines reference trajectories for the black and white keys 1*b*/1*c* to be moved. A series of values of target key position forms the reference trajectory, and the target key position is varied with time. The above-described reference point is found on the reference trajectory. The hammer 3 is brought into collision with the string 4 at the target hammer velocity at the end of the rotation in so far as the associated black key or associated white key passes through the reference point.

Music data codes, which express a performance, are supplied from a suitable information storage medium or another musical instrument to the music information processor 10*a* through a MIDI cable or a public communication network. The music information processor 10*a* firstly normalizes the pieces of music data, and converts the units used in the MIDI protocols to a system of units employed in the automatic player piano. In this instance, position, velocity and acceleration are expressed in millimeter-second system of units. Thus, pieces of playback data are produced from the pieces of music data through the music information processor 10*a*.

The motion controller 11 determines the reference trajectories for the black keys 1*b* and white keys 1*c* to be depressed and released in the playback. As described hereinbefore, the reference trajectory expresses a series of values of key position in terms of time. Therefore, the reference trajectory indicates the time at which the black key 1*b* or white key 1*c* starts to travel thereon.

The servo controller 12 determines the amount of mean current of the driving signal DR. In this instance, the pulse width modulation is employed in the servo controller 12 so that the amount of mean current is varied with the time period in the active level of the driving signal. The pieces of reference trajectory data are supplied from the motion controller 11 to the servo controller 12, and the servo controller 12 starts to supply the driving signal to the solenoid-operated actuator 5 associated with the black key 1*b* or white key 1*c* to be moved on the reference trajectory. While the black key 1*b* or white key 1*c* is traveling on the reference trajectory, the built-in plunger sensor 5*a* and key sensor 6 supply the plunger velocity signal ym and key position signal yk to the servo controller 12. The actual plunger velocity is approximately equal to the actual key velocity. The servo controller calculates a value of target key velocity on the basis of a series of values of target key position, and compares the actual key position and actual key velocity with the target key position and target key velocity so as to determine a value of positional deviation and a value of velocity deviation. When the positional deviation and velocity deviation are found, the servo controller 12 increases or decreases the amount of mean current of the driving signal in order to minimize the positional deviation and velocity deviation. Thus, the servo controller 12 forms a feedback control loop together with the solenoid-operated key actuators 5, built-in plunger sensors 5*a* and key sensors 6. The servo controller 12 repeats the servo control, and forces the black keys 1*b* and white keys 1*c* to travel on the reference trajectories.

The recording system 80 includes the key sensors 6, hammer sensors 7 and a recorder 13. The recorder 13 is realized through execution of another sub-routine program of the computer program.

The hammer sensors 7 monitor the hammers 3, respectively, and supply hammer position signals yh representative of pieces of hammer position data to the recorder 13. In this instance, the optical position transducer is used as the hammer sensors 7, and is same as that used as the key sensors 6.

While a human player is recording his or her performance on the upright piano 1, the recorder 13 periodically fetches the pieces of key position data and pieces of hammer position data, and analyzes the key movements and hammer movements on the basis of the pieces of key position data and pieces of hammer position data. The recorder 13 determines key numbers assigned to the depressed keys 1*b*/1*c* and released keys 1*b*/1*c*, time at which the black keys 1*b* and white keys 1*c* start to travel toward the end positions, actual key velocity on the way toward the end positions, time at which the black keys 1*b* and white keys 1*c* start to return toward the rest positions, the key velocity on the way toward the rest positions, time at which the hammers 3 are brought into collision with the strings 4 and final hammer velocity immediately before the collision. The recorder 13 produces MIDI music data codes from these pieces of music data. These sorts of data are referred to as "pieces of performance data". The central processing unit 20 normalizes the pieces of performance data so as to eliminate individuality of the automatic player piano from the pieces of performance data. The individualities of the automatic player piano are due to differences in sensor position, sensor characteristics and dimensions of component parts. Thus, the pieces of performance data of the automatic player piano are normalized into pieces of performance data of an ideal automatic player piano, and pieces of music data are produced from the pieces of performance data for the ideal automatic player piano.

Figure 2:
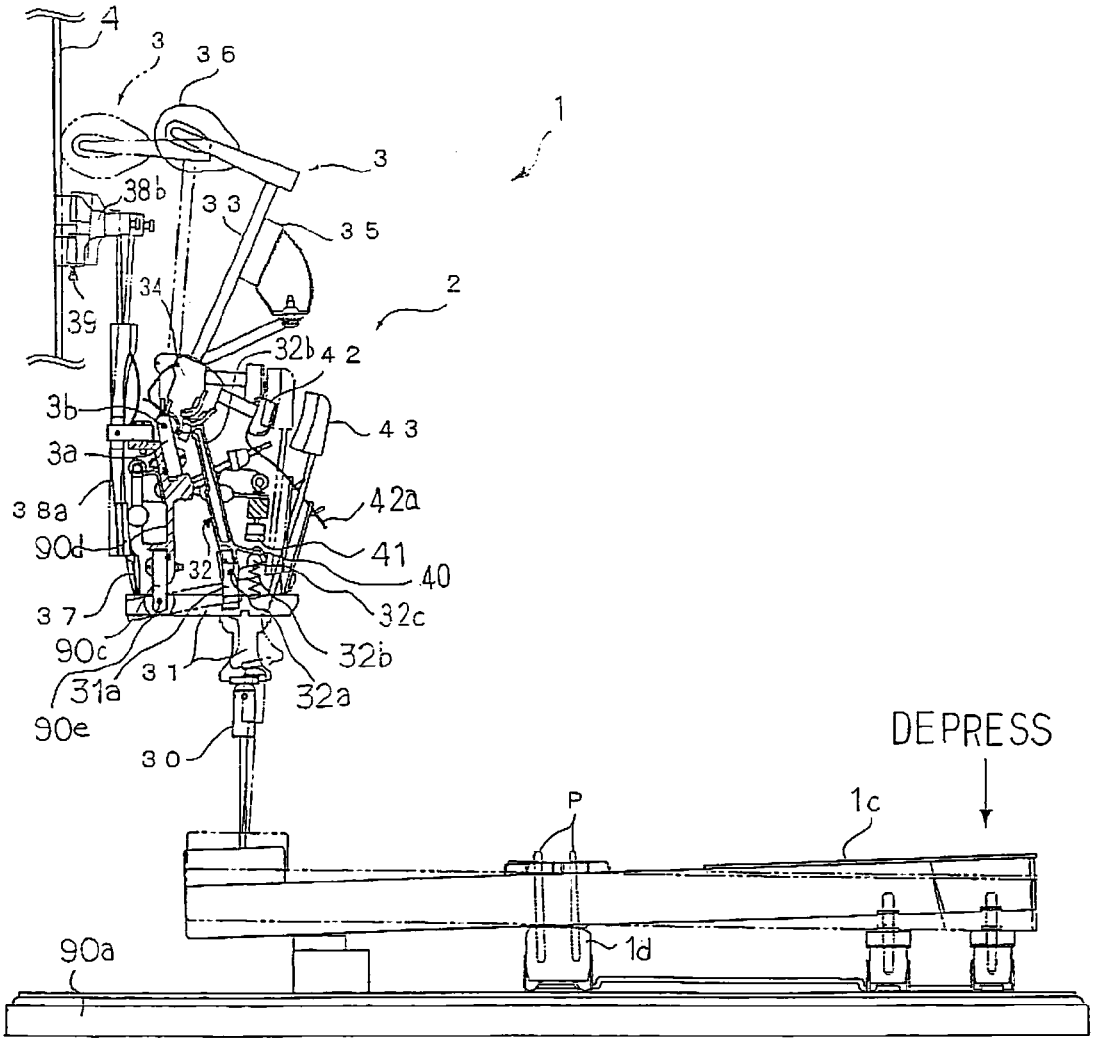
FIG. 2 is a side view showing the constitution of an action unit and a hammer incorporated in the automatic player piano.

Description is made on the action unit 2 and hammer 3 with reference to FIG. 2 in detail. Although only one set of action unit 2 and hammer 3 is illustrated in FIG. 2, other sets of action units 2 and hammers 3 are similar to the set of action unit 2 and hammer 3, and description on the other sets is omitted for the sake of simplicity. The solenoid-operated key actuators 5, key sensors 6 and hammer sensors 7 are not shown in FIG. 2 so that the constitution of action unit 2 is clearly seen in FIG. 2. While the associated white key 1*c* is staying at the rest position the action unit 2 and hammer 3 take the positions drawn by rear lines. When the string 4 is struck with the hammer 3 through non-escape white key 1*c*, the white key 1*c*, action unit 2 and hammer 3 take the positions drawn by dots-and-dash lines. The term "non-escape" and term "strike through non-escape" will be hereinlater described in detail.

The action unit 2 is hung from a center rail 90*d* by means of a whippen flange 90*c*, and is rotatable about the whippen flange 90*c*. The center rail 90 extends in the lateral direction, and is supported by action brackets (not shown). The center rail 90 is shared with the other action units 2, and the whippen flange 90*c* and whippen flanges of other action units 2 are bolted to the center rail 90*d* at intervals.

The action unit 2 includes a whippen assembly 31, a jack flange 31*a*, a jack 32, a damper spoon 37 and a back check 43. The whippen assembly 31 extends in the fore-and-aft direction, and a rear portion of whippen assembly 31 is connected to the lower end portion of the whippen flange 90*c* by means of a pin 90*e*. The capstan button 30 is held on contact with the lower end portion of the whippen assembly 31 so that the white key 1*c* upwardly pushes the whippen assembly 31 with the capstan button 30.

The jack flange 31*a* is secured to an intermediate portion of the whippen assembly 31, and upwardly projects from the whippen assembly 31. The jack flange 31*a* is connected to the jack 32 by means of a pin 32*a*, and a spring 32*b* is connected between the jack 32 and the whippen assembly 31. The jack 32 is urged in the counter clockwise direction by means of the spring 32*b*.

Figure 3:
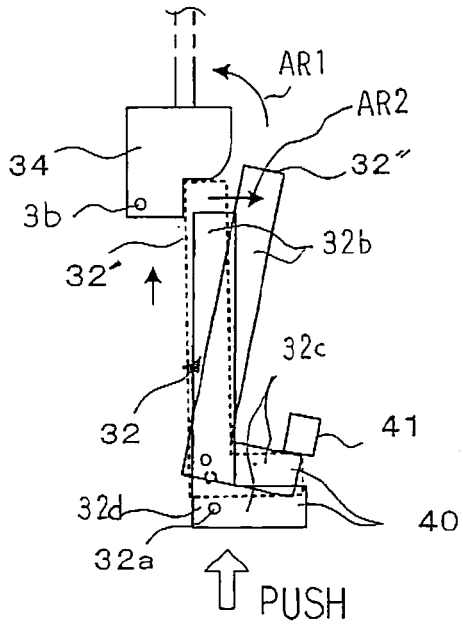
FIG. 3 is a schematic side view showing a jack escaping from a hammer butt.

The jack 32 is broken down into a leg portion 32*b* and a foot portion 32*c*, and the foot portion 32*c* has a toe 32*d*. As shown in FIG. 3, the pin 32*a* penetrates a heel 32*d* of the jack 32. A regulating button 41 is provided over the toe 40 of the jack 32, and is supported by the center rail 90*d*. The gap between the regulating button 41 and the toe 40 at the rest position is regulable.

The damper spoon 37 upwardly projects from the rearmost portion of the whippen assembly 31, and is provided in front of the lower end portion of a damper lever 38*a*, which is rotatably supported by the center rail 90*d*. A damper head 38*b* is connected to the upper end of the damper lever 38, and is held in contact with the string 4 at the rest position. While the whippen assembly 31 is rotating in the counter clockwise direction, the damper spoon 37 pushes the damper lever 38*a*, and gives rise to rotation of the damper lever 38*a* in the clockwise direction. This results in that the damper head 38*b* is spaced from the string 4.

The back check 43 upwardly projects from a front portion of the whippen assembly 31. The back check 43 will be hereinafter described in conjunction with the hammer 3.

The hammer 3 includes a butt flange 3*a*, a hammer shank 33, a hammer butt 34, a hammer head 36 and a catcher 42. The butt flange 3*a* is bolted to the center rail 90*d*, and the hammer butt 34 is rotatably connected to the butt flange 3*a* by means of a pin 3*b*. The leg portion 32*b* of jack 32 is in contact with the hammer butt 34. The hammer shank 33 upwardly projects from the hammer butt 34, and the catcher 42 projects from the hammer butt 34 in the frontward direction. The hammer head 36 is connected to the upper end portion of the hammer shank 33, and is opposed to the string 4 at the rest position. On the other hand, the catcher 42 is opposed to the back check 43 at the rest position, and is connected to the whippen assembly 31 by means of a bridle tape 42*a*.

While the white key 1*c* is staying at the rest position, the hammer shank 33 is held in contact with a hammer rail 35. The hammer rail 35 extends in the lateral direction, and is supported by the action brackets (not shown).

A human player is assumed to depress the white key 1*c*. The front portion of the white key 1*c* is sunk toward the end position. The rear portion of white key 1*c* is raised, and the capstan button 30 upwardly pushes the whippen assembly 31. Accordingly, the whippen assembly 31 starts to rotate about the pin 90*e* in the counter clockwise direction. The whippen assembly thus rotated gives rise to the rotation of hammer 3 and rotation of damper lever 38*a*.

The damper spoon pushes the damper lever 38*a* in the rearward direction so that the damper head 38*b* is spaced from the string 4. Thus, the string 4 gets ready to vibrate.

The jack 32 keeps the attitude on the whippen assembly 31, and pushes the hammer butt 34 as shown in FIG. 3 by broken lines. The hammer 3 slowly rotates in the counter clockwise direction as indicated by arrow AR1 in FIG. 3, and the hammer shank 33 leaves the hammer rail 35. The back check 43 rotates in the counter clockwise direction together with the whippen assembly 31.

The toe 40 is getting closer and closer to the regulating button 41. When the toe 40 is brought into contact with the regulating button 41, the jack 32 reaches a position 32', and the reaction causes the jack 32 to rotate about the pin 32*a* in the clockwise direction against the elastic force of the spring 32*b*.

The leg portion 32*b* slides on the lower surface of the hammer butt 34 at high speed from the position 32' to a position 32" as indicated by arrow AR2 in FIG. 3, and causes the hammer 3 to rotate in the counter clockwise direction. This phenomenon is called as "escape". The leg portion 32*b* leaves the hammer butt 34 through the escape, and does not force the hammer 3 to rotate alter the escape. While the leg portion 32*b* is sliding on the lower surface of the hammer butt 34, the jack 32 and hammer butt 34 are still in the escape. In other words, the escape is not completed. When the leg portion 32*b* leaves the lower surface of the hammer butt 34 at the end of the sliding, the escape is completed.

The hammer 3 starts the free rotation toward the string 4 through the escape. Since the jack 32 has accelerated the hammer 3 before the escape, the hammer 3 continues the rotation toward the string 4. The hammer head 36 is brought into collision with the string 4 at the end of the free rotation as indicated by dots-and-dash lines in FIG. 2, and rebounds on the string 4. The catcher 42 is brought into contact with the back check 43 and rests thereon. The white key 1*c* reaches the end position after the escape.

When the human player releases the white key 1*c*, the rear portion of white key 1*c* is sunk, and the whippen assembly 31 starts to rotate about the pin 90*e* in the clockwise direction. The hammer shank 33 reaches the damper rail 35, and the back check 43 leaves the catcher 42. Finally, the action unit 2 reaches the initial position.

As described hereinbefore, when the jack 32 leaves the lower surface of the hammer butt 34 through the sliding, the escape is completed. This means that the jack 32 is still in the "non-escape" state in so far as the leg portion 32*b* is still in contact with the lower surface of the hammer butt 34. Even though the jack 32 is still in the non-escape state, it is possible to cause the hammer 3 to start the free rotation in so far as the jack 32 has well accelerated the hammer 3. The hammer head 36 is similarly brought into collision with the string 4 at the end of the free rotation, and gives rise to the vibrations of string 4. Thus, the present inventors found that the tone was produced at the strike with the hammer 2 without completion of the escape. The strike without completion of the escape is referred to as the "strike through non-escape". Since the strike through non-escape merely consumes time shorter than the time consumed in the strike through the escape, it is possible to reproduce high-speed key movements such as the repletion by using the strike through non-escape.

Figure 4:
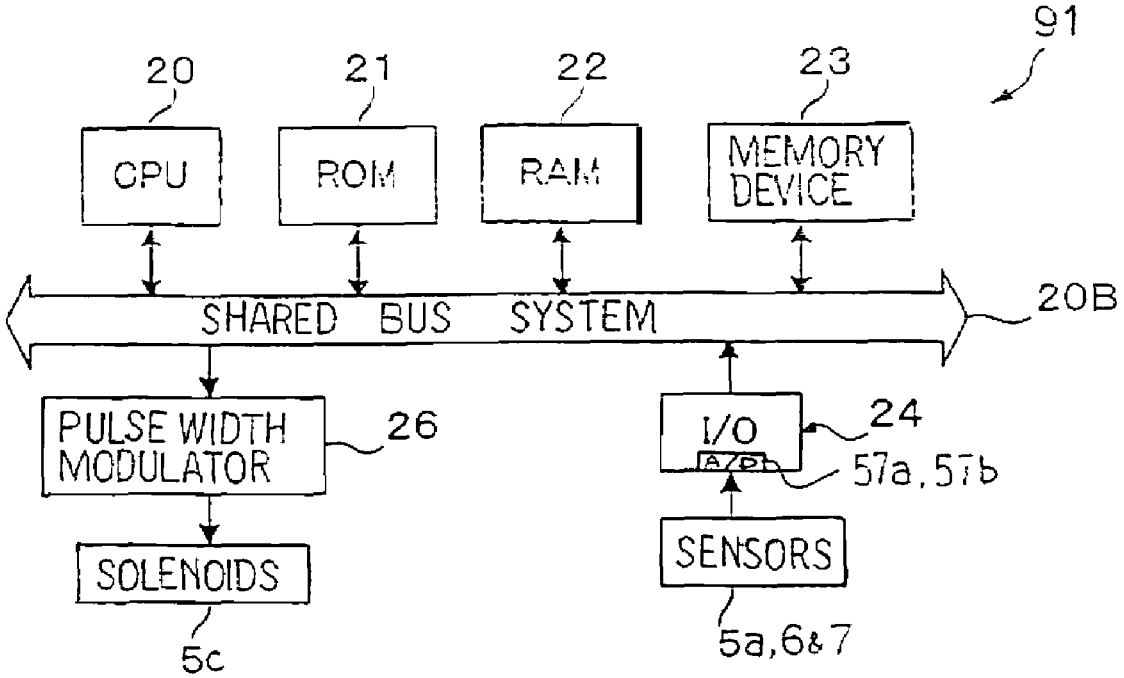
FIG. 4 is a block diagram showing the system configuration of a controller incorporated in the automatic player piano.

Turning to FIG. 4 of the drawings, a controlling unit 91 includes a central processing unit 20, which is abbreviated as "CPU", a read only memory 21, which is abbreviated as "ROM", a random access memory 22, which is abbreviated as "RAM", a memory device 23, a signal interface 24, which is abbreviated as "I/O", a pulse width modulator 26 and a shared bus system 20B. The central processing unit 20, read only memory 21, random access memory 22, memory device 23, signal interface 24 and pulse width modulator 26 are connected to the shared bus system 20B so that the central processing unit 20 is communicable with the read only memory 21, random access memory 22, memory device 23, signal interface 24 and pulse width modulator 26 through the shared bus system 20B. Although an electronic tone generator, a display panel and a manipulating board are incorporated in the controlling unit 91, they are omitted from FIG. 4 together with a graphic controller and a switch detector for the sake of simplicity.

Analog-to-digital converters 57*a* and 57*b* are incorporated in the signal interface 24, and the plunger sensors 5*a*, key sensors 6 and hammer sensors 7 are connected to the analog-to-digital converters 57*a* and 57*b* of the signal interface 24. The driving signals DR are selectively supplied from the pulse width modulator 25 to the solenoids 5*c* of solenoid-operated key actuators 5. A MIDI interface and suitable digital interface for a personal computer system are incorporated in the interface 24.

The central processing unit 20 is an origin of the data processing capability, and a computer program runs on the central processing unit 20 for given tasks.

Instruction codes, which form the computer program, are stored in the read only memory 21, and are sequentially fetched by the central processing unit 20. The computer program will be hereinafter described in detail. Semiconductor mask ROM devices and semiconductor electrically erasable and programmable ROM devices are incorporated in the read only memory 21. Suitable parameter tables are further stored in the read only memory 21, and the central processing unit 20 looks up the parameter tables for the automatic playing and recording.

The random access memory 22 offers a working area to the central processing unit 20, and pieces of music data, pieces of position data and pieces of velocity data are, by way of example, temporarily stored in the working area. A memory location is assigned to an internal clock, which is implemented by software, and the lapse of time from the initiation of playback is measured with the internal clock.

The memory device 23 has data holding capability much larger than that of the random access memory 22, and is, by way of example, implemented by a hard disk driver, a flexible disk driver such as a floppy disk driver, the term "floppy disk" of which is a trademark, a compact disk driver for a CD-ROM (Compact Disk Read Only Memory), an MO (Magneto-Optical) disk, a DVD (Digital Versatile Disk) and a zip disk. A set of music codes may be transferred from the memory device 23 to the random access memory 22 for the automatic playing and vice versa for the recording. Plural music data files are usually prepared in the memory device 23. In this instance, each set of music data codes forms a standard MIDI file.

Figure 5:
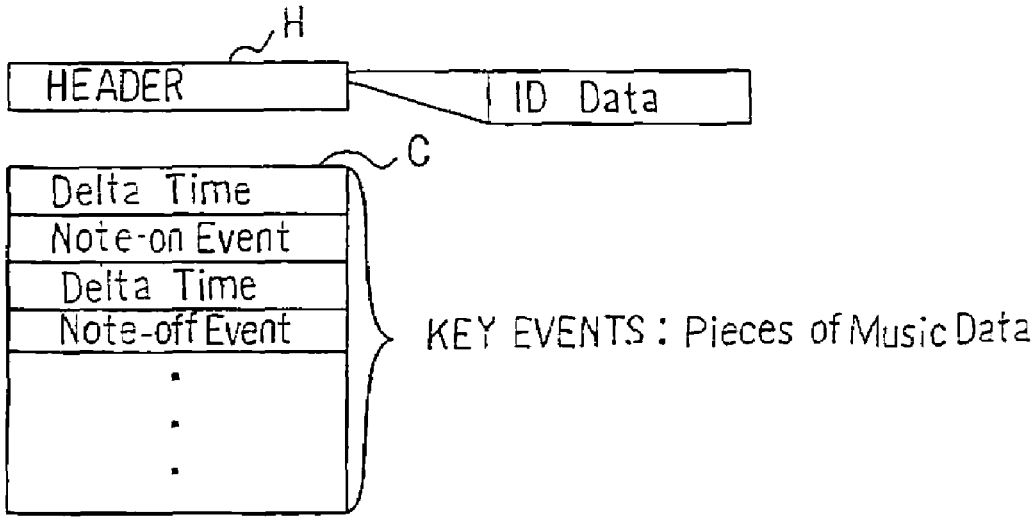
FIG. 5 is a view showing the structure of a MIDI standard file.

FIG. 5 shows one of the standard MIDI files. The standard MIDI file is broken down into a header H and a data chunk C. Pieces of identification data are stored in the header H, and pieces of music data are stored in the data chunk C.

One of the pieces of identification data expresses a sort of musical instrument through which the pieces of music data are created. The piece of identification data is stored in the form of a binary code, and one of the bits of the binary code is indicative of the model of action units 2. In this instance, bit "0" is indicative of the action units incorporated in upright pianos, and bit "1" is indicative of action units incorporated in grand pianos.

The data chunk C follows the header H. The pieces of music data express the key events and lapse of time from the previous key events. The key, i.e., the key-on event and key-off event are expressed as a "note-on event" and a "note-off event", and the lapse of time is referred to as a "delta time". The note-on event and note-off event are referred to as a "note event". The note event is expressed by a status byte and a data byte or bytes. The status byte expresses a note-on message/a note-off message and a channel message. On the other hand, the data bytes express a note number, i.e., the pitch of a tone to be produced and a velocity of the tone. Since the delta time expresses the lapse of time from the previous note event, the lapse of time from the initiation of performance is indicated through accumulation of the values of delta time. In the following description, the lapse of time from the previous note event. i.e., the lapse of time expressed by the delta time is referred to as a "relative time period", and the lapse of time from the initiation of a performance, i.e., the accumulated delta time is referred to as an "absolute time period".

Computer Program

The computer program is broken down into a main routine program and subroutine programs. The main routine program makes the automatic playing system 10 and recording system 80 initialized, and checks the switch detector (not shown) to see whether or not the user gives an instruction to the automatic playing system 10 or recording system 80.

One of the subroutine programs is assigned to the automatic playing system 10, and another subroutine program is assigned to the recording system 80. Yet another subroutine program is assigned to determination of the model of action units installed in the automatic player piano on which the automatic playing system 10 reenacts a performance. Still another subroutine program is prepared for the servo control. The servo controller 12 is realized through the execution of the subroutine program for the servo control.

Figure 6:
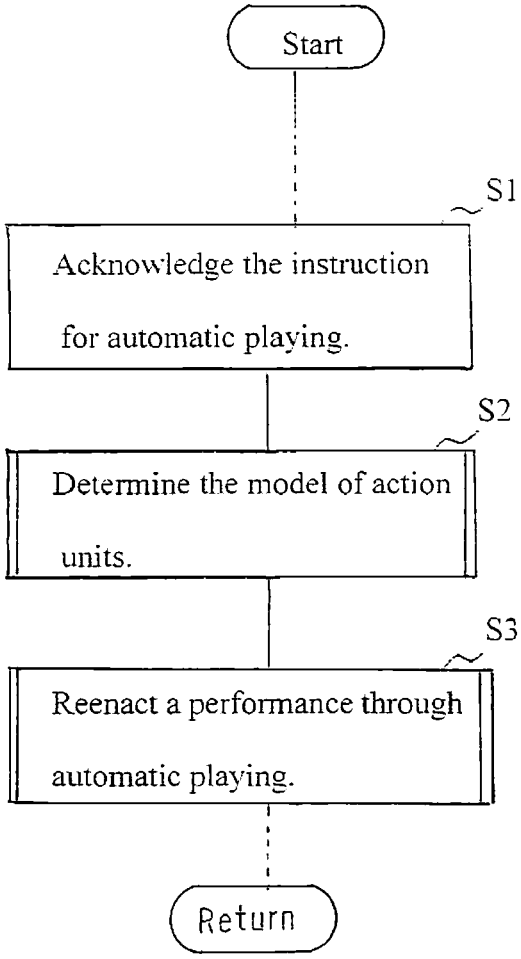
FIG. 6 is a flowchart showing a control sequence in order to reenact a performance

FIG. 6 shows the relation among the main routine program, subroutine program for determination of the model of action units 2 and subroutine program for the automatic playing. While the main routine program is running on the central processing unit 20, a user instructs the automatic playing system 10 to reenact a performance expressed by a set of music data codes. The central processing unit 20 acknowledges the user's instruction as by step S1, and the main routine program starts periodically to branch to the subroutine program S2 for determination of the model of action units 2. The central processing unit 20 determines the model of action units 2 through the execution as will be described hereinlater, and proceeds to the subroutine program for the automatic playing. When the automatic playing system 10 completes the performance on the music tune, the central processing unit 20 returns to the main routine program.

Figure 7:
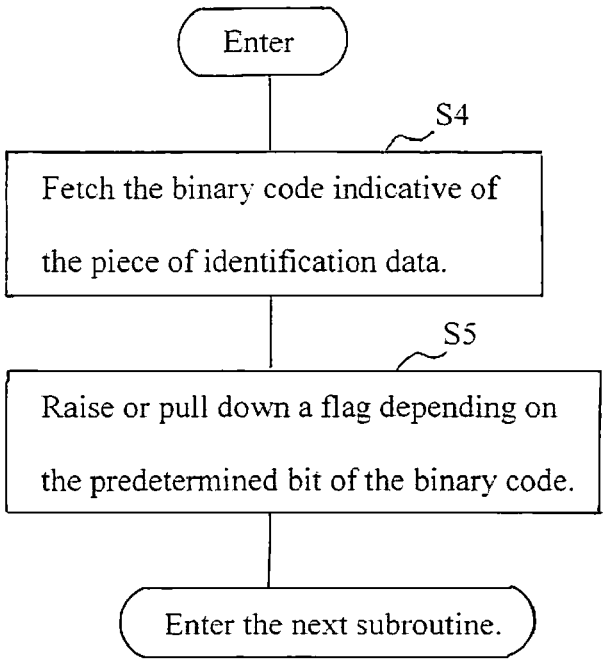
FIG. 7 is a flowchart showing a job sequence of a subroutine program for determination of a model of action units.

FIG. 7 illustrates jobs in the subroutine program S2 for determination of the model of action units 2. When the central processing unit 20 enters the subroutine program S2, the pieces of identification data are read out from the standard MIDI file as by step S3.

Subsequently, the central processing unit 20 checks the predetermined bit to see what model of action units is installed in the acoustic piano, and raises or pulls down the flag indicative of the model of action units 2 as by step S5. Thus, the central processing unit 20 discriminates the model of action units 2 of the upright piano 1 from other models of action units such as action units of grand pianos and other instruments without any action units such as, for example, electronic keyboards, sequencers and personal computer systems. The action units 2 of upright pianos are referred to as "upright key actions", and the others are called as "non-upright key actions". In case where any action units do not participate in the generation of tones, the term "non-upright key actions" is used for those keyboard musical instruments and non-musical instruments.

Upon completion of the job at step S5, the central processing unit 20 enters the subroutine program S3 for the automatic playing.

Figure 8:
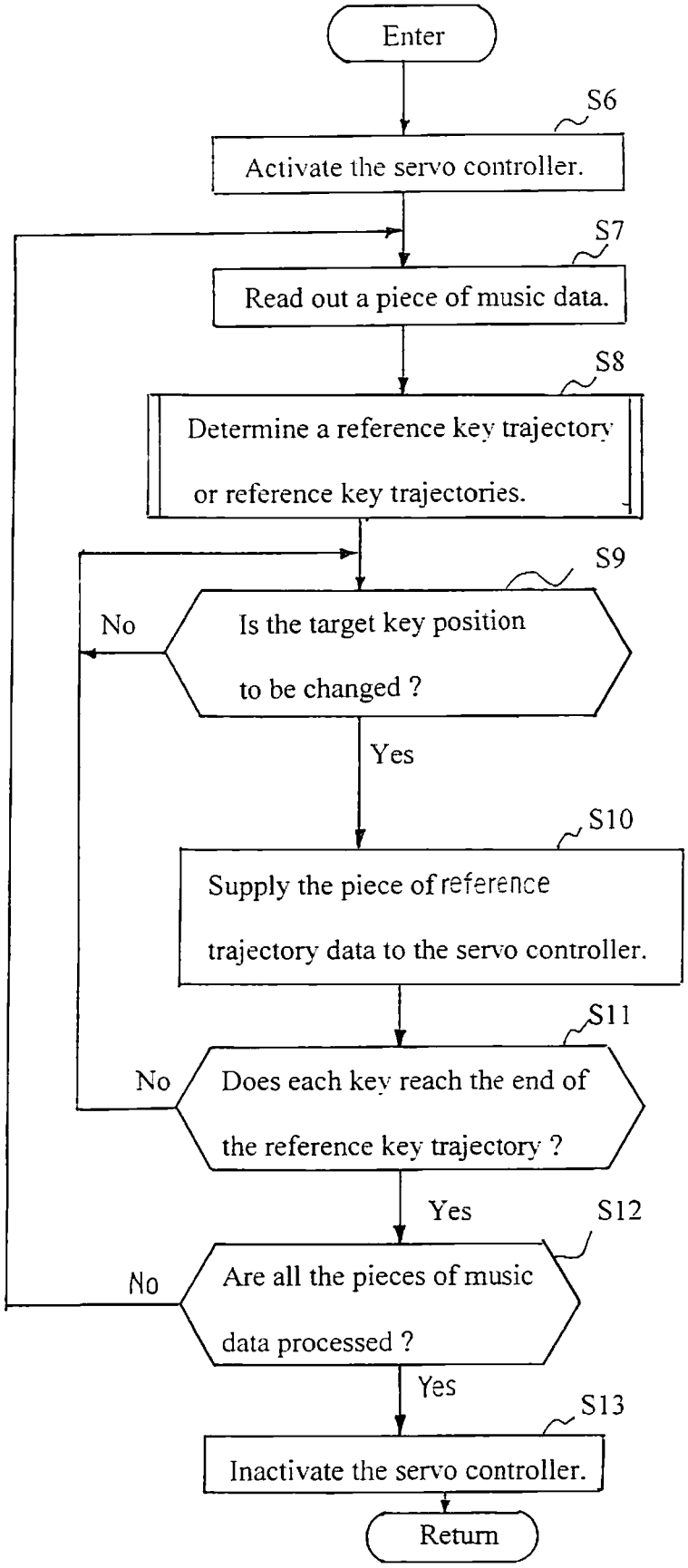
FIG. 8 is a flowchart showing a job sequence of a subroutine program for an automatic playing.

The subroutine program for the automatic playing is hereinafter described with reference to FIG. 8. Although the black keys 1*b* and white keys 1*c* are selectively repeatedly pushed and released during the automatic playing, description is made on a key event on a certain white key 1*c* for the sake of simplicity. The pieces of music data in the data chunk are transferred from the memory device 23 to the random access memory 22.

Upon entry into the subroutine program S3, the servo controller 12 is activated as by step S6. As described hereinbefore, the servo control is realized through execution of the subroutine program. The main routine program starts periodically to branch into the subroutine program for the servo control.

The central processing unit 20 modifies the pieces of music data with the individualities of the automatic player piano, and converts the system of units from those defined in the MIDI protocols to the millimeter-second system. As a result, the velocity is converted to the target key velocity in millimeters per second. The relative time periods are converted to the absolute time periods through the accumulation of the values of delta time, and the note-on events and note-off events are plotted on the time base. Thus, the pieces of playback data are prepared. Thereafter, the central processing unit 20 starts sequentially to read out the music data codes, which form the data chunk C, as by step S7. The jobs at step S7 are corresponding to the functions of the music information processor 10*a*.

The central processing unit 20 is assumed to find a music data code expressing the note-on for the certain white key 1*c*. The central processing unit 20 searches a music data code expressing the note-off event for the same key, and determines the reference key trajectory toward the end position and the reference key trajectory toward the rest position. The reference key trajectory toward the end position and reference key trajectory toward the rest position is referred to as a "reference key trajectory pair", and the reference key trajectory pair and a reference key trajectory between the arrival time at the end position and starting time at the end position are hereinafter referred to as a "reference key trajectory group". These reference key trajectories, i.e., reference key trajectory group is stored in the working area of the random access memory 22 as by step S8. The reference key trajectory pair is determined through a subroutine program, and the subroutine program for the reference key trajectory pair is hereinlater described with reference to FIG. 9.

Subsequently, the central processing unit 20 periodically checks the internal clock to see whether or not the time to change the target key position comes as by step S9. While the time is running toward the absolute time to change the target key position, the answer at step S9 is given negative "No", and the central processing unit 20 repeats the job at step S9. When the absolute time to change the target key position comes, the answer at step S9 is changed to affirmative "Yes". The central processing unit 20 starts to force the certain white key 1*c* to travel on the reference key trajectory at the first change to the positive answer at step S9.

With the positive answer "Yes" at step S9, the central processing unit 20 supplies the piece of reference trajectory data to the servo controller 12 as by step S10. The central processing unit 20 fetches the piece of position data represented by the key position signal yk and the piece of velocity signal ym, and calculates actual key velocity and actual plunger position on the basis of a series of values of the actual key position and a series of values of the plunger velocity, respectively. The central processing unit 20 further calculates target key velocity on the reference key trajectory. The central processing unit 20 compares the target key position and target key velocity with the actual key position/actual plunger position and the actual key velocity/actual plunger velocity to see whether or not the white key 1*c* reaches the end position as by step S11. While the white key 1*c* is traveling on the reference key trajectory toward the end position, the answer at step S11 is given negative "No", and the central processing unit 20 returns to step S9. Thus, the central processing unit 20 repeats the loop consisting of steps S9, S10 and S11, and forces the white key 1*c* to travel on the reference key trajectory. The certain white key 1*c* makes the jack 32 escape from the hammer butt 34 on the reference key trajectory toward the end position. The hammer 3 starts the rotation toward the string 4, and is brought into collision with the string 4. Thus, the hammer 3 gives rise to the vibrations of the string 4 so that the acoustic piano tone is produced through the vibrations of the string 4.

When the absolute time to return toward the end position comes, the answer at step S9 is changed to affirmative "yes", and the central processing unit 20 starts to supply the pieces of reference trajectory data expressing the key trajectory toward the rest position to the servo controller 12 at step S10. The servo controller 12 forces the certain white key 1*c* to travel on the reference key trajectory toward the rest position. When the certain white key 1*c* passes through a point to make the damper 3 brought into contact with the string 4, the acoustic piano tone is rapidly decayed. Thus, the note-off event occurs under the control of the servo controller 12.

When the certain white key 1*c* reaches the end of the reference key trajectory, the answer at step S11 is changed to affirmative "Yes", the central processing unit proceeds to step S12, and checks the random access memory 22 to see whether or not all of the pieces of music data have been already processed as by step S12.

If the a piece of music data is left unprocessed, the answer at step S12 is given negative "No" and the central processing unit 20 returns to step S7. Thus, the central processing unit 20 reiterates the loop consisting of steps S7 to S12, and sequentially drives the solenoid-operated key actuators 5 so as to produce the tones along the music tune.

When the central processing unit 20 confirms that any piece of music data is not left unprocessed, the answer at step S12 is changed to affirmative "Yes", and proceeds to step S13. The central processing unit 20 makes the servo controller 12 inactive at step S13, and, thereafter, returns to the main routine program.

Figure 9:
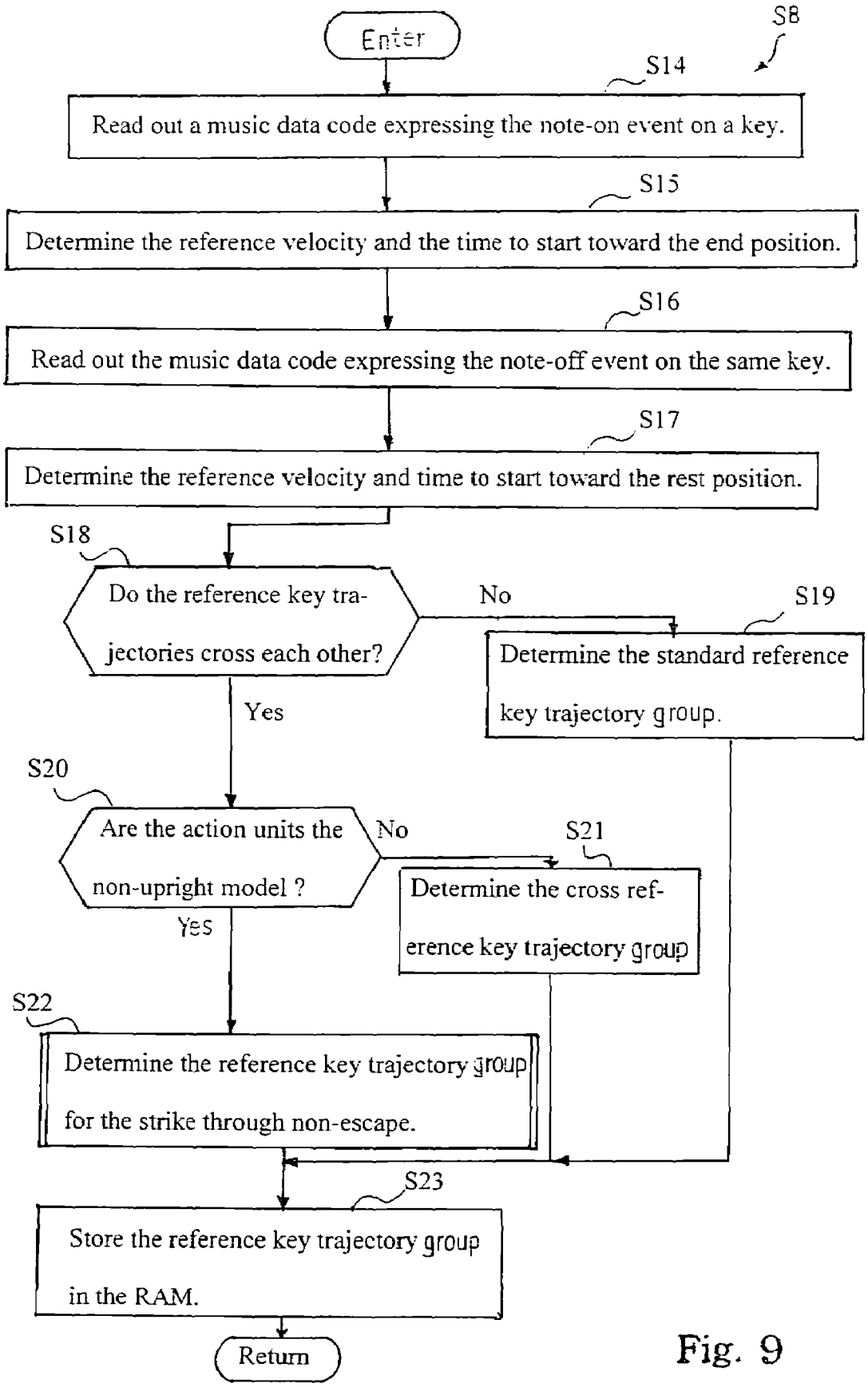
FIG. 9 is a flowchart showing a job sequence for determining reference key trajectories.

FIG. 9 illustrates a job sequence of the subroutine program S8 for determining the reference key trajectories. In this instance, the black keys 1*b* and white keys 1*c* take uniform motion on the reference key trajectories so that straight lines express the reference key trajectories. In this instance, the reference key trajectories are categorized into three groups.

In case where the black keys 1*b* and white keys 1*c* are to be controlled to travel from the rest positions to the end positions and vice versa, the reference key trajectories are categorized in the first group, and are referred to as "standard reference key trajectories", which form parts of a "standard reference key trajectory group".

In case where the black keys 1*b* and white keys 1*c* are to be controlled to change the direction of movements before the rest positions and end positions such as those in the half-stroke keys, the reference key trajectories are categorized in the second group and third group depending upon the model of action units. If the upright action units are employed, the reference key trajectories are categorized in the second group, and are referred to as "cross reference key trajectories", which form a "cross reference key trajectory group". If, on the other hand, the non-upright action units are employed, the reference key trajectories are categorized in the third group, and are referred to as "reference key trajectories for the strike through non-escape" which form a "reference key trajectory group for the strike through non-escape".

The central processing unit 20 is assumed to enter the subroutine program S8. The central processing unit 20 reads out the piece of playback data expressing the note-on event from the random access memory 22 as by step S14, and determines the final hammer velocity VH and impact time TH at which the hammer 3 is brought into collision with the string 4.

The central processing unit 20 further determines the reference key velocity Vr and reference time Tr at which the black key 1*b* or white key 1*c* passes through the reference point as by step S15. The reference point is determined through experiments and is found between 9.0 millimeters and 9.5 millimeters under the rest position. As described hereinbefore in conjunction with the related arts, the reference key velocity Vr is proportional to the final hammer velocity VH, and the final hammer velocity VH is proportional to the loudness of tone produced through the vibrations of string 4.

Since the black keys 1*b* and white keys 1*c* are assumed to take the uniform motion, the reference key velocity Vr is expressed as $$Vr=\alpha\times VH+\beta \qquad \text{Equation 1}$$

where α and β are coefficients determined through experiments. ΔT expresses time lag between the reference time Tr and the impact time TH. The relation between the time lag ΔT and the impact time TH is well approximated with a hyperbola in the experiments. For this reason, the time lag ΔT is expressed as $$\Delta T=-(\gamma/VH)+\delta \qquad \text{Equation 2}$$

where γ and δ are coefficients determined through experiments. When the time lag ΔT is determined by using Equation 2, the reference time Tr is earlier than the impact time TH by the time lag ΔT.

Since the black key 1*b* or white key 1*c* travels from the rest position XR to the reference point X in the uniform motion, the key consumes time period (X/Vr) from the rest position to the reference point X, and the absolute time TR at which the black key 1*b* or white key 1*c* starts toward the end position is expressed as (Tr−X/Vr). From the above-discussed relations, (Vr×(t−TR)+XR) expresses the reference key trajectory toward the end position.

Upon completion of jobs at step S15, the central processing unit reads out the piece of playback data expressing the note-off event on the same key from the random access memory 22 as by step S16, and determines released key velocity VKN, which is less than zero, and key released time TH, at which the black key 1*b* or white key 1*c* starts toward the rest position, on the basis of the piece of playback data.

The central processing unit 20 determines reference key velocity VrN on the reference key trajectory toward the rest position and decay time TrN at which the damper 39 is brought into contact with the string 4. The key position at which the damper 39 is brought into contact with the vibrating string 4 is referred to a reference point XN on the reference key trajectory toward the rest position, and the reference key velocity VrN is the released key velocity at the reference point XN. The reference key velocity VrN is less than zero. The black key 1*b* or white key 1*c* reaches the reference point XN at the decay time TrN. In this instance, there is the end position XE at the keystroke of 10 millimeters. The released key 1*b* or 1*c* consumes relative time TrN' from the end position XE and the reference point XN, and the reference point XN is expressed as $$XN=VrN\times TrN'+XE \qquad \text{Equation 3}$$

Since the released key 1*b* or 1*c* is moved in the uniform motion, the initial key velocity is equal to the reference key velocity VrN, which is equal to the released key velocity VKN.

The relative time TrN' is determined by using equation 3. Since the relative time TrN' is consumed by the released key 1*b* or 1*c* moved from the end position XE to the reference point XN, released time TEN, at which the released key 1*b* or 1*c* starts the end position XE, is earlier than the decay time TrN by the relative time TrN'. Since the decay time TrN and relative time TrN' have been already determined, the central processing unit 20 can determine the released time TEN. Accordingly, the reference key trajectory toward the rest position is expressed as (VrN×(t−TEN)+XE).

The reference key velocity pair is expressed as (Vr×(t−TR)+XR) and (VrN×(t−TEN)+XE). Then, the central processing unit examines the reference key velocity pair to see whether or not the reference key trajectory toward the end position crosses the reference key trajectory toward the rest position as by step S18.

When any crossing point is not found, the pieces of playback data are indicative of the full-stroke between the rest position and the end position, and the central processing unit 20 determines that the reference key trajectories (Vr×(t−TR)+XR) and (VrN×(t−TEN)+XE) form the standard reference key trajectory group together with the reference key trajectory between the time TE and the TEN as by step S19.

If the central processing unit 20 finds a crossing point between the reference key trajectories (Vr×(t−TR)+XR) and (VrN×(t−TEN)+XE), the pieces of playback data express the half-stroke such as those in the repetition, and the answer at step S18 is given affirmative.

With the positive answer "Yes" at step S18, the central processing unit 20 proceeds to step S20, and checks the flag to see whether the action units 2 are categorized in the upright action units or the non-upright action units as by step S20.

If the flag is equivalent to bit "0", the action units 2 are categorized in the upright action units, and the answer at step S20 is given negative "No". With the negative answer "No", the central processing unit 20 determines that the half-stroke is reproducible in the automatic player piano, and the cross reference key trajectory group is obtained as follows.

The depressed key 1*b* or 1*c* starts the rest position XR at time TR, and reaches the end position XE at time TE. On the other hand, the released key starts the end position XE at time TEN, and reaches the rest position at time TRN. These two trajectories cross each other at time Tc, and the time Tc is expressed as $$Tc=(Vr\times TE-VrN\times TEN)/(Vr-VrN) \qquad \text{Equation 4}$$

The reference key trajectory (Vr×(t−TR)+XR) from the time TR to time Tc and reference key trajectory (VrN×(t−TEN)+XE) from the time Tc to time TRN form the cross reference key trajectory group.

If the flag is raised or equivalent to bit "1", there is a possibility that the half-stroke is not reproduced, and the answer at step S20 is given affirmative "Yes". With the positive answer "Yes", the central processing unit 20 determines the reference key trajectory group for the strike through non-escape through the execution of a subroutine program S22.

Figure 10:
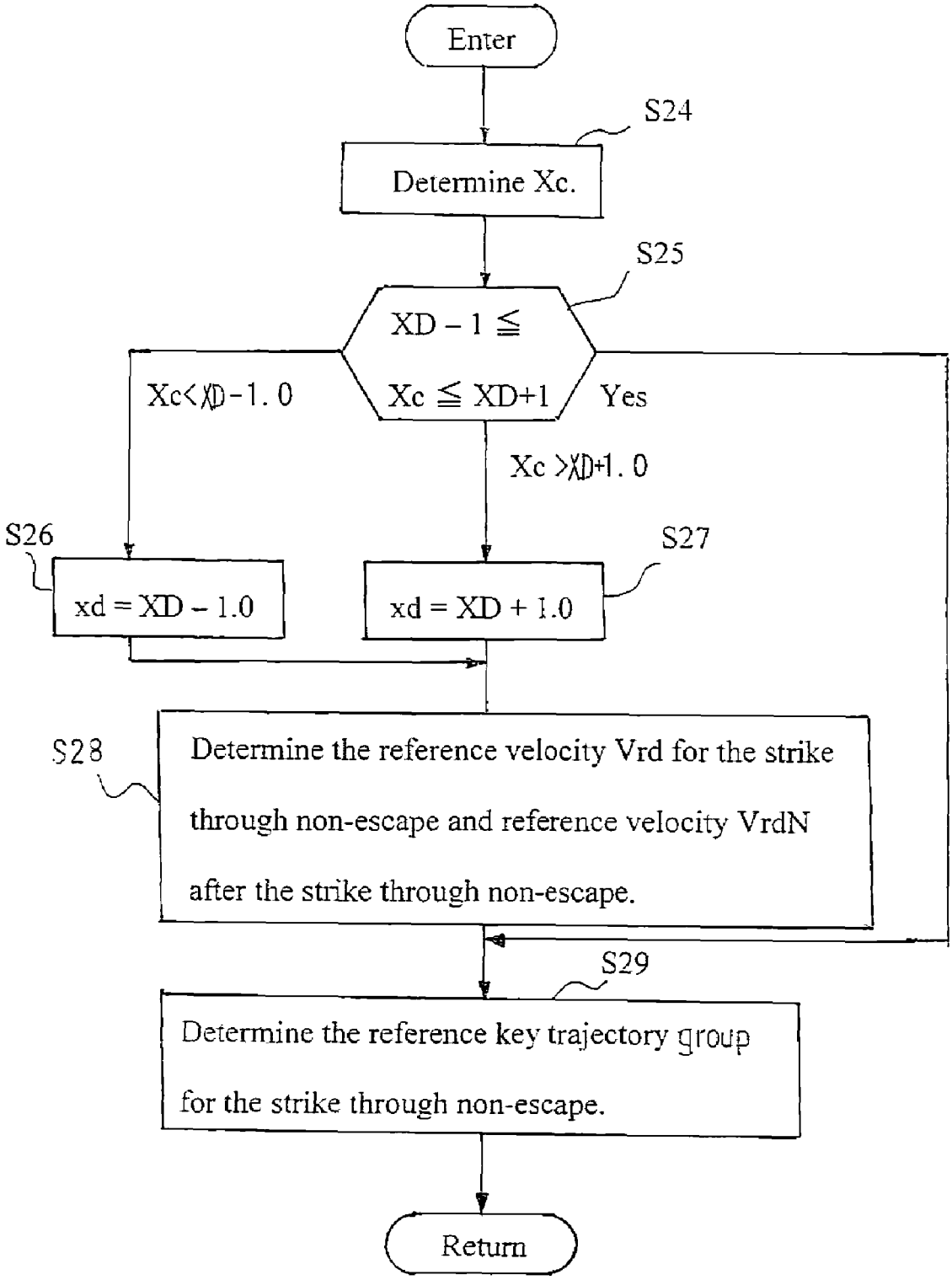
FIG. 10 is a flowchart showing a job sequence for determining reference key trajectories for a strike through non-escape.
Figure 11:
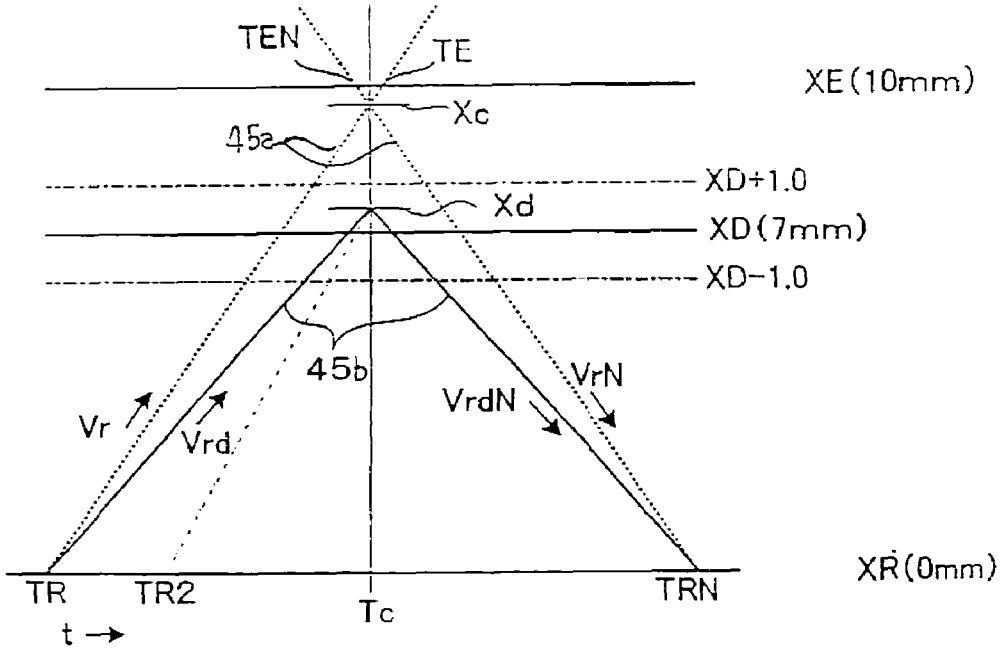
FIG. 11 is a graph showing a reference key trajectory group for a strike through a non-escape.

FIG. 10 illustrates a job sequence of the subroutine program S22, and FIG. 11 shows a cross reference key trajectory group 45*a* and a reference key trajectory group for the strike through non-escape 45*b*. Description is made on the strike through non-escape with reference to FIGS. 10 and 11. A black/white key 1*b*/1*c* travels on the cross reference key trajectory group 45*a* at the key velocity of Vr and VrN and these two reference key trajectories cross each other at time Tc. The crossing point is labeled with "Xc". The time Tc and crossing point Xc are calculated on the basis of the two reference key trajectories of the cross reference key trajectory group.

When the central processing unit 20 determines that the black/white key 1*b*/1*c* has to travel on the reference key trajectory group 45*b*, the cross reference key trajectory group 45*a* is replaced with the reference key trajectory group 45*b*. The black/white key 1*b*/1*c* travels toward a crossing point Xd at the key velocity of Vrd, and toward the rest position TRN at the key velocity of VrdN. The crossing point Xd is farther from the end position XE than the crossing point Xc. However, the black/white key 1*b*/1*c* reaches the crossing point Xd at the same time Tc. This results in that the associated solenoid-operated key actuator 5 causes the black/white key 1*b*/1*c* slowly to travel between the rest position XR and the crossing point Xd so as to reduce the keystroke from Xc to Xd. Thus, the reference key trajectory group for the strike through non-escape is featured by the keystroke shorter than that in the cross reference key trajectory group.

"XD" stands for the optimum keystroke for the strike through non-escape. The present inventor determines the optimum keystroke of the automatic player piano implementing this embodiment through experiments. As described hereinbefore, the end position XE is spaced from the rest position XR by 10 millimeters. The optimum keystroke XD was of the order of 7 millimeters from the rest position XR, and the black keys 1*b* and white keys 1*c* were to be controlled within the optimum key stroke XD plus minus 1 millimeter, i.e., (7±1) millimeters. The optimum key stroke XD plus minus 1 millimeter is referred to as an "allowable range".

The central processing unit 20 controls the white key 1*c* on the above-described conditions as follows. First, the central processing unit 20 determines the crossing point Xc as by step S24. The crossing point Xc is given by Equation 5.

$$Xc=XR+Vr\times(Tc-Tr) \qquad \text{Equation 5}$$

where XR is zero.

Subsequently, the central processing unit 20 compares the crossing point Xc with the optimum keystroke XD to see whether or not the calculation result is fallen within the allowable range. i.e., (7±1) millimeters as by step S25.

If the crossing point Xc is closer to the rest position XR than the allowable range. i.e., Xc<XD−1.0, the central processing unit 20 determines that the crossing point Xd is to be at the shallowest keystroke in the allowable range, i.e., XD−1.0 as by step S26.

If the crossing point Xc is farther from the rest position XR than the allowable range, i.e., Xc>XD+1.0, the central processing unit 20 determines that the crossing point ad is to be at the deepest keystroke in the allowable range, i.e., XD+1.0 as by step S27.

After the jobs at step S26 or S27, the central processing unit 20 calculates the reference key velocity Vrd and VrdN on the basis of the change from the crossing point Xc to the crossing point Xd as by step S28. The reference key velocity Vrd is given as (Vr×(Xd/Xc)), and the other reference key velocity VrdN is given as (VrN×(Xd/Xc)). The reference key velocity Vr and VrN has been already determined as by step S15 and S17.

On the other hand, when the crossing point Xc is fallen within the allowable range, the central processing unit 20 the central processing unit 20 uses the cross reference key trajectory group 45*a* for the strike through non-escape without any change as by step S29. The central processing unit 20 returns to the subroutine program shown in FIG. 9.

When the central processing unit 20 returns to the subroutine program shown in FIG. 9, the central processing unit 20 stores the pieces of reference trajectory data expressing the reference key trajectory group, which are determined at one of the steps S19, S21 and S22, in the random access memory 22 as by step S23.

Figure 12:
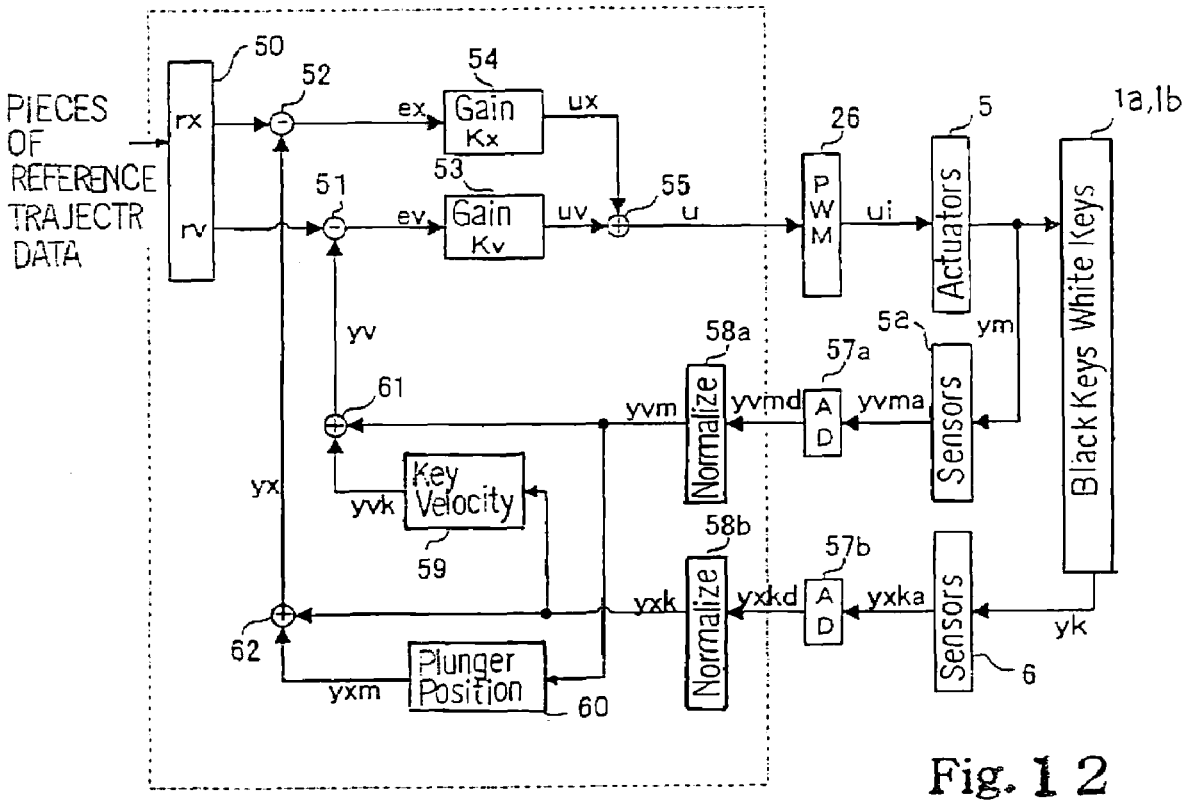
FIG. 12 is a block diagram showing a servo control on a black/white key.
Figure 13:
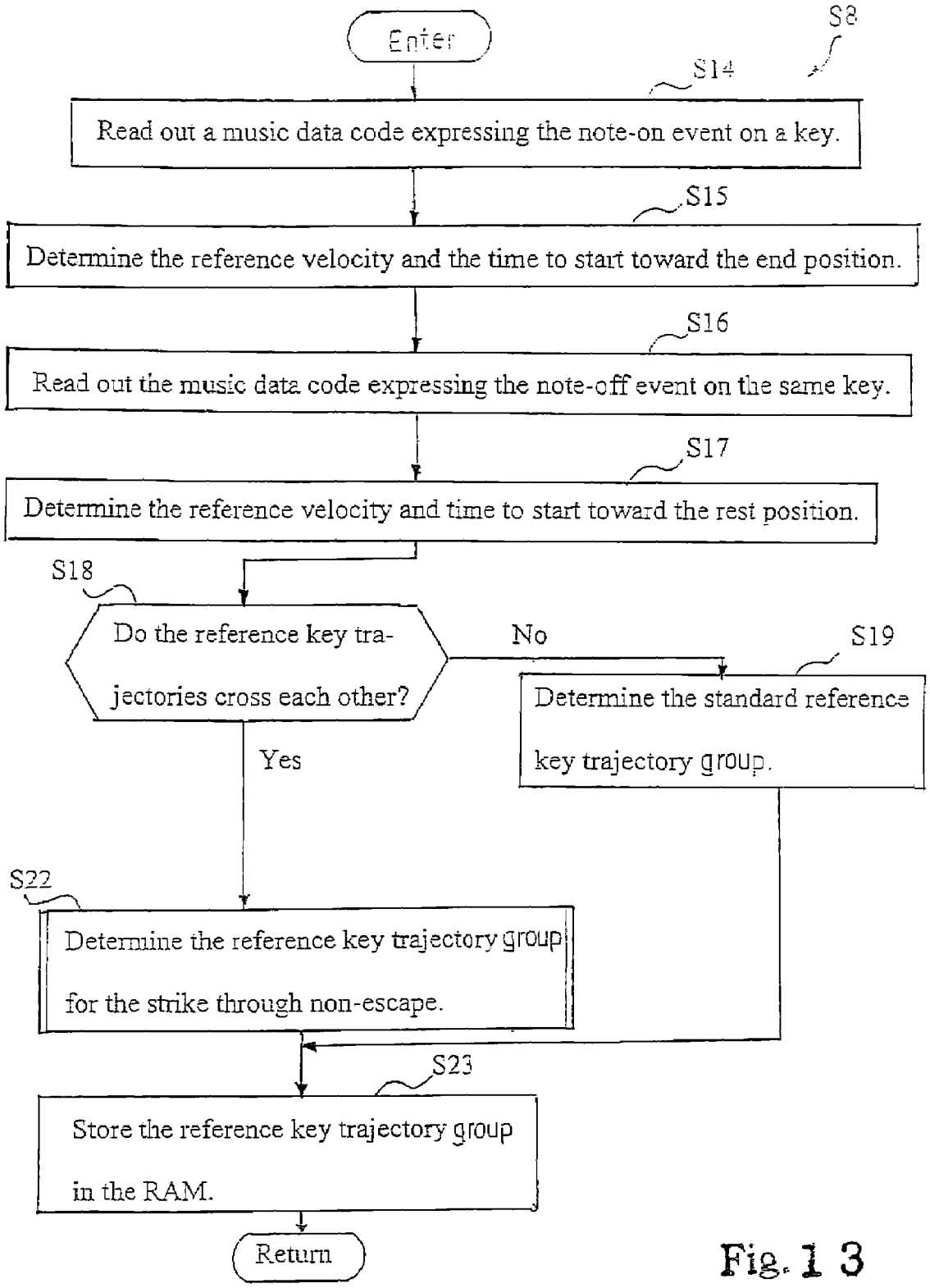
FIG. 13 is a flowchart showing a job sequence for determining reference key trajectories executed in another automatic player piano of the present invention.

FIG. 12 shows a servo control sequence. The pieces of reference trajectory data are assumed to be transferred to the servo controller 12 at time intervals of 1 mill-second. Blocks in broken lines stand for functions of the servo controller 12. The black/white key 1*b*/1*c* is forced to travel on the reference key trajectory group as follows.

A piece of reference trajectory data, which expresses a present value rx of the target key position, is assumed to reach a target value calculator 50. The target value calculator 50 determines a present value rv of the target key velocity on the basis of a series of previous values of the target key position. In this instance, the black and white keys 1*b* and 1*c* are assumed to take the uniform motion on the target key trajectories so that the target key velocity is constant. While the black/white key 1*b*/1*c* is traveling on the reference key trajectory toward the end position, the target key velocity rv is equal to the reference key velocity Vr or Vrd. On the other hand, the target key velocity rv is equal to the reference key velocity VrN or VrdN on the reference key trajectory toward the rest position.

On the other hand, the analog-to-digital converters 57*a* and 57*b* periodically samples the key position signal yk and plunger velocity signal ym, and converts the discrete value yxka on the key position signal yk and discrete value yvma on the plunger position signal ym to a digital key position signal yxkd and a plunger velocity signal yvmd, respectively at time intervals equal to those of the pieces of reference trajectory data.

The digital key position signal yxkd and digital plunger velocity signal yvmd are normalized to a digital normalized key position signal yxk and a digital normalized plunger velocity signal yvm as by blocks 58*b* and 58*a*, respectively. The individualities of automatic player piano are eliminated from the digital key position signal yxkd and digital plunger velocity signal yvmd, and the key position and plunger velocity are expressed in the unit system millimeter-second.

A current plunger position yxm is calculated on the basis of a series of values of the current plunger velocity yvm through an integration as by block 60, and a current key velocity yvk is calculated on the basis of a series of values of the current key velocity yxk through a differentiation or a polynomial approximation as by block 59.

The value of current plunger velocity yvm is added to the value of current key velocity yvk as by block 61, and the value of current plunger position yxm is added to the value of the current key position yxk as by block 62. The sum yv of velocity and sum yx of current position are respectively compared with the value of target velocity rv and value of target position rx, and determines a velocity difference ev and a positional difference ex as by blocks 51 and 52. The value of velocity difference ev and value of positional difference ex are respectively multiplied by gains Kv and Kx, respectively as by blocks 53 and 54.

The product uv is added to the product ux as by block 55, and the sum u is supplied to the pulse width modulator 26. The pulse width modulator 26 adjusts the driving signal DR to the sum u. As a result, the driving signal DR has a value ui of mean current. The driving signal DR is supplied to the solenoid-operated key actuator 5.

The above-described servo control sequence is repeated at the time intervals of 1 millisecond so that the black/white key 1*b*/1*c* is forced to travel on the reference key trajectory group. In case where the central processing unit 20 determines the reference key trajectory group for the strike through non-escape at step S28, the servo controller 12 successively reads out the pieces of reference trajectory data expressing the reference key trajectory group from the random access memory 22, and controls the solenoid-operated key actuator 5 so as to give rise to the free rotation of the hammer 3 without any escape.

In more detail, the depressed key 1*b*/1*c* causes the whippen assembly 31 and jack 32 to rotate about the pin 90*e* in the counter clockwise direction in FIG. 2, and stops the depressed key 1*b*/1*c* at the crossing point Xd. While the whippen assembly 31 and jack 32 are rotating about the pin 90*e* the jack 32 pushes the hammer 3, and gives rise to the rotation of the hammer 3. When the black/white key 1*b*/1*c* stops the movement, the hammer 3 is separated from the jack 32, and starts the rotation toward the string 4. Although the hammer 3 without the escape is slower than the hammer 3 rotated through the escape, the keystroke for the non-escape is shorter than the keystroke for the escape. As a result, the hammer 3 is brought into collision with the string 4 at the target time Tc.

As described hereinbefore, the promptness of action units 2 is poorer than the promptness of action units incorporated in a grand piano. In other words, although the servo controller 12 can not makes the black keys 1*b* and white keys 1*c* travel at high speed due to the poor promptness of action units 2, the short keystroke Xd makes it possible to repeat the tone at time intervals as short as those of the original performance on the grand piano.

Second Embodiment

An automatic player piano implementing the second embodiment is similar to the automatic player piano already described except for a job sequence of a subroutine program S8' for determination of reference key trajectory group. The subroutine program S8' forms a part of a computer program for the automatic player piano implementing the second embodiment. The main routine program and other subroutine programs are same as those of the computer program installed in the automatic player piano implementing the first embodiment. For this reason, description is made on the subroutine program S8' only.

Although the standard reference key trajectory group, cross reference key trajectory group and reference key trajectory group for the strike through non-escape are selectively assigned to the key movements expressed by the pieces of music data, either standard reference key trajectory group or key trajectory group for the strike through non-escape is selectively assigned to each key movement through the execution of subroutine program S8'. For this reason, steps S20 and S21 are not incorporated in the subroutine program S8'.

The advantages of the first embodiment are achieved by the automatic player piano implementing the second embodiment.

Moreover, the computer program for the second embodiment is simpler than that for the first embodiment.

Although particular embodiments of the present invention have been shown and described, it will be apparent to those skilled in the art that various changes and modifications may be made without departing from the spirit and scope of the present invention.

The music information processor 10*a*, motion controller 11, servo controller 12 and recorder 13 may be implemented by wired logic circuits.

The key sensors 6 and plunger sensors 5*a* may be replaced with key sensors producing key velocity signals or key acceleration signals and plunger sensors producing plunger position signals or plunger acceleration signals. This is because of the fact that the position, velocity and acceleration are convertible to one another through the integration and/or differentiation. An optical transducer, the combination of a Hall element and a pieces of permanent magnet and the combination of a Wheatstone bridge circuit and a piece of weight are available for the plunger, key and hammer sensors.

The computer program may be stored in the memory device, and is transferred from the memory device 23 to the random access memory 22. The computer program may be downloaded from a program source through a public communication network.

The optimum keystroke XD for the strike through non-escape is dependent on the structure of action units employed in the automatic player piano. The dimensions of action units further have the influence on the optimum keystroke XD. Thus, 7 millimeters is an example of the optimum keystroke.

In the first and second embodiments, the reference key trajectory group for the strike through non-escape is produced on the basis of the cross reference key trajectory group. This feature does not set any limit to the technical scope of the present invention. The reference key trajectory group for the strike through non-escape may be calculated as similar to the cross reference key trajectory group on the assumption that the crossing point XD serves as the end position.

The reference key trajectories may be determined on the assumption that the black keys 1*b* and white keys 1*c* take the uniformly accelerated motion. Otherwise, the reference key trajectories may be determined on the assumption that the uniformly accelerated motion follows the uniform motion or another combination of different sorts of motion.

The servo control may be carried out on differences in different sorts of physical quantity such as, for example, position, velocity, acceleration and pressure on the lower surfaces of the black and white keys.

The keyboard musical instruments, to which the present invention appertains, may be an automatic percussion musical instrument different in key mechanism from a percussion musical instrument on which an original performance is carried out. The percussion musical instrument may be a celesta. Several sorts of electronic keyboard musical instruments have action units, and the present invention appertains to these sorts of electronic keyboard musical instrument. Thus, the pianos do not set any limit to the technical scope of the present invention.

An automatic playing system may move the black and white keys 1*b* and 1*c* at the key velocity Vr and VrN along the reference key trajectory group for the strike through non-escape. Since the crossing point Xd is farther from the end position than the crossing point Xc, the time to start the rest position is delayed from time TR to time TR2 as shown in FIG. 11. The keystroke may be physically restricted by a suitable stopper or a stopper for a whippen assembly.

The promptness of action units may be directly inspected by the automatic playing system 10. For example, the controlling unit 91 repeatedly energizes the solenoid-operated key actuators 5, and evaluates the promptness of action units 2 on the basis of the behavior of action units 2. The hammer sensors 7 may participate in the evaluation. Thus, the pieces of identification data are not indispensable.

The solenoid-operated key actuators do not set any limit to the technical scope of the present invention. A hydraulic actuator or a pneumatic actuator or an electric motor is available for the automatic playing system.

The servo control is not indispensable. Another controller may simply vary the mean current of the driving signal depending upon the reference key trajectory groups without any feedback control loop.

The component parts and jobs are correlated with claim languages as follows. The upright piano 1 is corresponding to a "musical instrument". The black keys 1*b* and white keys 1*c* serve as "plural manipulators". The key movements from the rest positions to the end positions are corresponding to "full-stroke movements", and the key movements for the half stroke and key movements in repetition are examples of "other movements". The strings 4 as a whole constitute a "tone generator". The music information processor 10*a* and motion controller 11 serve as a "reference trajectory producer", and the controlling unit 91 and the jobs S4, S5, S6 to S13 realize the reference trajectory producer. The servo controller 12 is corresponding to a "controller", and the tasks for the servo controller 12 are accomplished through the servo control loop shown in FIG. 12.

The header 11 is corresponding to a "background data portion", and the data chunk C is corresponding to a "music data portion".

The reference key trajectory toward the end position is corresponding to a "forward reference trajectory" and the reference key trajectory toward the rest position is corresponding to a "backward reference trajectory".

What is claimed is:

1. An automatic player musical instrument for performing a piece of music on the basis of pieces of music data, comprising:

a musical instrument including plural manipulators independently moved for specifying the pitch of tones to be produced selectively through full-stroke movements and other movements, plural action units respectively actuated by said plural manipulators, and provided with jacks, respectively, plural hammers associated with said jacks, respectively and driven for rotation through escape of said jacks, and a tone generator producing said tones at said pitch specified through said plural manipulators in response to said rotation of said plural hammers; and an automatic playing system including plural actuators provided in association with said plural manipulators, respectively, and responsive to a driving signal so as selectively to move said plural manipulators, a reference trajectory producer examining said pieces of music data to see whether said full-stroke movements or said other movements are to be requested for said plural manipulators for determining reference key trajectory groups for said plural manipulators depending upon the movements to be requested and having a first reference key trajectory group producing module producing selected ones of said reference key trajectory groups for the manipulators causing the associated hammers to start said rotation through said escape, thereby producing said tones through said escape between said hammers and said jacks and a second reference key trajectory group producing module producing one of said reference key trajectory groups for one of said plural manipulators causing associated one of said plural hammers to start said rotation without said escape so as to produce one of said other movements, thereby producing said tones without said escape, and a controller connected to said plural actuators and said reference trajectory producer and regulating a magnitude of said driving signal so as to cause said plural manipulators to travel on said reference trajectory groups.

2. The automatic player musical instrument as set forth in claim 1, in which a stroke of said one of said plural manipulators is shorter than a full-stroke in the full-stroke movement when one of said pieces of music data causes said one of said plural manipulators to give rise to the rotation of associated one of said hammers without said escape.

3. The automatic player musical instrument as set forth in claim 2, further comprising a data storage facility where plural memory locations are defined for said pieces of music data, in which one of said plural memory locations assigned to said one of said pieces of music data has a data field for storing a sub-piece of music data expressing the tone repeatedly to be produced through said one of said plural manipulators so that said controller and associated one of said plural actuators force said one of said plural manipulators repeatedly to travel over said stroke shorter than said full-stroke for repeatedly producing said tone.

4. The automatic player musical instrument as set forth in claim 2, in which said reference trajectory producer has a tester, which includes a data acquisition module acquiring a piece of property data expressing promptness of said plural action units and another piece of property data expressing the promptness of action units of another musical instrument used in preparation of said pieces of music data, and a decision making module connected to said data acquisition module and comparing said piece of property data with said another piece of property data to see whether or not said promptness of said action units is poorer than said promptness of said action units of said another musical instrument, and a reference trajectory determining module connected to said decision making module and preparing said one of said reference trajectory groups on the conditions that the answer of said decision making module is given affirmative and that said one of said plural manipulators is to travel over said stroke shorter than said full-stroke.

5. The automatic player musical instrument as set forth in claim 4, further comprising a data storage facility where plural memory locations are defined for said pieces of music data, in which one of said plural memory locations assigned to one of said pieces of music data has a data field where said piece of property data is stored.

6. The automatic player musical instrument as set forth in claim 5, in which said one of said pieces of music data is stored in a background data portion of a music data file, and other pieces of music data expressing said piece of music are stored in a music data portion of said music data file.

7. The automatic player musical instrument as set forth in claim 6, in which said music data file is prepared in accordance with MIDI protocols.

8. The automatic player musical instrument as set forth in claim 2, in which another of said reference trajectory groups is prepared for another of said plural manipulators expected to travel over said full-stroke, and said another of said reference trajectory groups has a forward reference trajectory from a rest position of said another of said plural manipulators to an end position of said another of said plural manipulators and a backward reference trajectory from said end position to said rest position and a reference trajectory at said end position.

9. The automatic player musical instrument as set forth in claim 8, in which said one of said reference trajectory groups has said forward reference trajectory crossing said backward reference trajectory at a crossing point between said rest position and said end position.

10. The automatic player musical instrument as set forth in claim 9, in which yet another of said reference trajectory groups has said forward reference trajectory crossing said backward reference trajectory at another crossing point between said crossing point and one of said rest and end positions, and said reference trajectory producer prepares said one of said reference trajectory groups for said one of said plural manipulators on the condition that said action units are poorer in promptness than action units of another musical instrument through which said pieces of music data are prepared and said yet another of said reference trajectory groups for yet another of said plural manipulators on the condition that said action units of said musical instrument are close in promptness to said action units of said another musical instrument.

11. An automatic playing system for producing tones on the basis of pieces of music data through a musical instrument having plural manipulators, plural action units respectively connected to said plural manipulators and respectively provided with jacks, plural hammers driven for rotation through escape of said jacks and a tone generator producing said tones in response to said rotation of said hammers, comprising:

plural actuators provided in association with said plural manipulators, respectively, and responsive to a driving signal so as selectively to move said plural manipulators;

a reference trajectory producer examining said pieces of music data to see whether full-stroke movements or other movements are to be requested for said plural manipulators for determining reference key trajectory groups for said plural manipulators depending upon the movements to be requested and having a first reference trajectory group producing module producing selected ones of said reference key trajectory groups for the manipulators causing the associated hammers to start said rotation through said escape, thereby producing said tones through said escape between said hammers and said jacks and a second reference trajectory group producing module producing one of said reference key trajectory groups for one of said plural manipulators causing associated one of said plural hammers to start said rotation without said escape so as to produce one of said other movements, thereby producing said tones without said escape; and a controller connected to said plural actuators and said reference trajectory producer, and regulating a magnitude of said driving signal so as to cause said plural manipulators to travel on said reference trajectory groups.

12. The automatic playing system as set forth in claim 11, in which a stroke of said one of said plural manipulators is shorter than a full-stroke in the full-stroke movement when one of said pieces of music data causes said one of said plural manipulators to give rise to the rotation of associated one of said hammers without said escape.

13. The automatic playing system as set forth in claim 12, further comprising a data storage facility where plural memory locations are defined for said pieces of music data, in which one of said plural memory locations assigned to said one of said pieces of music data has a data field for storing a sub-piece of music data expressing the tone repeatedly to be produced through said one of said plural manipulators so that said controller and associated one of said plural actuators force said one of said plural manipulators repeatedly to travel over said stroke shorter than said full-stroke for repeatedly producing said tone.

14. The automatic playing system as set forth in claim 12, in which said reference trajectory producer has a tester, which includes a data acquisition module acquiring a piece of property data expressing promptness of said plural action units and another piece of property data expressing the promptness of action units of another musical instrument used in preparation of said pieces of music data, and a decision making module connected to said data acquisition module and comparing said piece of property data with said another piece of property data to see whether or not said promptness of said action units is poorer than said promptness of said action units of said another musical instrument, and reference trajectory determining module connected to said decision making module and preparing said one of said reference trajectory groups on the conditions that the answer of said decision making module is given affirmative and that said one of said plural manipulators is to travel over said stroke shorter than said full-stroke.

15. The automatic playing system as set forth in claim 14, further comprising a data storage facility where plural memory locations are defined for said pieces of music data, in which one of said plural memory locations assigned to one of said pieces of music data has a data field where said piece of property data is stored.

16. The automatic playing system as set forth in claim 15, in which said one of said pieces of music data is stored in a background data portion of a music data file, and other pieces of music data expressing said piece of music are stored in a music data portion of said music data file.

17. The automatic playing system as set forth in claim 16, in which said music data file is prepared in accordance with MIDI protocols.

18. The automatic playing system as forth in claim 12, in which another of said reference trajectory groups is prepared for another of said plural manipulators expected to travel over said full-stroke, and said another of said reference trajectory groups has a forward reference trajectory from a rest position of said another of said plural manipulators to an end position of said another of said plural manipulators and a backward reference trajectory from said end position to said rest position and a reference trajectory at said end position.

19. The automatic playing system as set forth in claim 18, in which said one of said reference trajectory groups has said forward reference trajectory crossing said backward reference trajectory at a crossing point between said rest position and said end position.

20. The automatic playing system as set forth in claim 19, in which yet another of said reference trajectory groups has said forward reference trajectory crossing said backward reference trajectory at another crossing point between said crossing point and one of said rest and end positions, and said reference trajectory producer prepares said one of said reference trajectory groups for said one of said plural manipulators on the condition that said action units are poorer in promptness than action units of another musical instrument through which said pieces of music data are prepared and said yet another of said reference trajectory groups for yet another of said plural manipulators on the condition that said action units of said musical instrument are close in promptness to said action units of said another musical instrument.

* * * * *